US010513908B2

(12) United States Patent
Scott et al.

(10) Patent No.: US 10,513,908 B2
(45) Date of Patent: Dec. 24, 2019

(54) MECHANISMS FOR TRANSFERRING HYDRAULIC CONTROL FROM A PRIMARY SAFETY VALVE TO A SECONDARY SAFETY VALVE

(71) Applicant: Halliburton Energy Services, Inc., Houston, TX (US)

(72) Inventors: Bruce Edward Scott, McKinney, TX (US); James Dan Vick, Jr., Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 52 days.

(21) Appl. No.: 15/753,161

(22) PCT Filed: Sep. 17, 2015

(86) PCT No.: PCT/US2015/050765
§ 371 (c)(1),
(2) Date: Feb. 15, 2018

(87) PCT Pub. No.: WO2017/048265
PCT Pub. Date: Mar. 23, 2017

(65) Prior Publication Data

US 2018/0202261 A1 Jul. 19, 2018

(51) Int. Cl.
*E21B 34/10* (2006.01)
*E21B 34/16* (2006.01)
*E21B 34/00* (2006.01)

(52) U.S. Cl.
CPC ..... *E21B 34/106* (2013.01); *E21B 34/16* (2013.01); *E21B 2034/005* (2013.01)

(58) Field of Classification Search
CPC ... E21B 34/106; E21B 34/16; E21B 2034/005
See application file for complete search history.

(56) References Cited

U.S. PATENT DOCUMENTS 4,258,786 A * 3/1981 Lochte ..... E21B 34/16 137/625.18
4,273,186 A 6/1981 Pearce et al.
(Continued)

OTHER PUBLICATIONS

International Search Report and Written Opinion from PCT/US2015/050765, dated Jun. 10, 2016, 15 pages.

*Primary Examiner* — Taras P Bemko
*Assistant Examiner* — Brandon M Duck
(74) *Attorney, Agent, or Firm* — McGuireWoods LLP

(57) ABSTRACT

Wellbore systems containing a hydraulically regulated primary safety valve may have their hydraulic regulation transferred to an insert safety valve disposed in a nipple. Such wellbore systems may comprise: a tubing string comprising a nipple and a primary safety valve, the primary safety valve being disposed in the tubing string below the nipple; and a control line and a balance line in hydraulic communication with the primary safety valve and in latent hydraulic communication with one or more switching mechanisms in the nipple. The one or more switching mechanisms in the nipple are actuatable to shut off hydraulic communication of the control line and the balance line below the nipple and to redirect, via one or more latent hydraulic lines, the hydraulic communication of the control line and the balance line to an insert safety valve positioned in a bore of the nipple.

18 Claims, 15 Drawing Sheets

(56) References Cited

U.S. PATENT DOCUMENTS

| | | | | |
|---|---|---|---|---|
| 4,294,315 | A | 10/1981 | Yonker et al. | |
| 4,418,750 | A | 12/1983 | Paschal, Jr. | |
| 4,901,798 | A * | 2/1990 | Amani | E21B 34/10 166/311 |
| 6,298,919 | B1 * | 10/2001 | Browne | E21B 23/04 166/373 |
| 8,640,769 | B2 | 2/2014 | Smith et al. | |
| 2006/0196669 | A1 | 9/2006 | Lauderdale et al. | |

* cited by examiner

MECHANISMS FOR TRANSFERRING HYDRAULIC CONTROL FROM A PRIMARY SAFETY VALVE TO A SECONDARY SAFETY VALVE

BACKGROUND

The present disclosure generally relates to subterranean wellbore operations and equipment and, more specifically, to mechanisms for transferring hydraulic control from a primary safety valve to an insert safety valve.

Subsurface safety valves (SSSVs) are well known in the oil and gas industry and provide one of many failsafe mechanisms to prevent the uncontrolled release of wellbore fluids should a wellbore system experience a loss in containment. Typically, subsurface safety valves comprise a portion of a tubing string set in place during completion of a wellbore. Although a number of design variations are possible for subsurface safety valves, the vast majority are flapper-type valves that open and close in response to longitudinal movement of a flow tube. Since subsurface safety valves provide a failsafe mechanism, the default positioning of the flapper is usually closed in order to minimize the potential for inadvertent release of wellbore fluids. The flapper can be opened through various means of control from the earth's surface in order to provide a flow pathway for production to occur.

In many instances, the flow tube can be regulated from the earth's surface using a piston and rod assembly that may be hydraulically charged via a control line linked to a hydraulic manifold or control panel. The term "control line" will be used herein to refer to a hydraulic line configured to displace the flow tube of a subsurface safety valve downward upon pressurization, or otherwise to become further removed from the exit of a wellbore. When sufficient hydraulic pressure is conveyed to a subsurface safety valve via the control line, the piston and rod assembly forces the flow tube downward, which causes the flapper to move into its open position upon overcoming forces that tend to keep the flapper closed (e.g., biasing springs, downhole pressure, and the like). When the hydraulic pressure is removed from the control line, the flapper can return to its default, closed position. A self-closing mechanism, such as a torsion spring, can also be present to promote closure of the flapper should a loss of hydraulic pressure occur.

Some subsurface safety valves can also employ a second hydraulic line configured to counterbalance the effects of the control line and to provide an additional means of regulating the flow tube. The term "balance line" will be used herein to refer to a hydraulic line configured to displace the flow tube of a subsurface safety valve upward upon pressurization, or otherwise to become less removed from the exit of a wellbore. A balance line, when present, can operate in a similar manner to a control line and be controlled from the earth's surface.

Depending on operational considerations, a subsurface safety valve may be placed hundreds to thousands of feet downhole. During downhole placement of a subsurface safety valve, numerous opportunities exist for inadvertent damage to occur to the control line and/or the balance line, including line severance, thereby rendering the line(s) inoperative for regulating the subsurface safety valve. Line damage can also occur after a subsurface safety valve has been set in place and is in operational use. In addition to issues associated with the control line and/or the balance line, subsurface safety valves may become damaged due to corrosion or scaling and no longer function properly. In the event of hydraulic failure or related damage to a subsurface safety valve, very expensive and time-consuming workover operations may be needed to replace the non-functioning valve.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, as will occur to one having ordinary skill in the art and the benefit of this disclosure.

DETAILED DESCRIPTION

The present disclosure generally relates to subterranean wellbore operations and equipment and, more specifically, to mechanisms for transferring hydraulic control from a primary safety valve to an insert safety valve.

One or more illustrative embodiments incorporating the features of the present disclosure are presented herein. Not all features of a physical implementation are necessarily described or shown in this application for the sake of clarity. It is to be understood that in the development of a physical implementation incorporating the embodiments of the present disclosure, numerous implementation-specific decisions may be made to achieve the developer's goals, such as compliance with system-related, business-related, government-related and other constraints, which may vary by implementation and from time to time. While a developer's efforts might be time-consuming, such efforts would be, nevertheless, a routine undertaking for one having ordinary skill in the art and the benefit of this disclosure.

In the description herein, directional terms such as "above", "below", "upper", "lower", and the like, are used for convenience in referring to the accompanying drawings. In general, "above", "upper", "upward" and similar terms refer to a direction toward the exit of a wellbore, often toward the earth's surface, and "below", "lower", "downward" and similar terms refer to a direction away from the exit of a wellbore, often away from the earth's surface.

Figure 1:
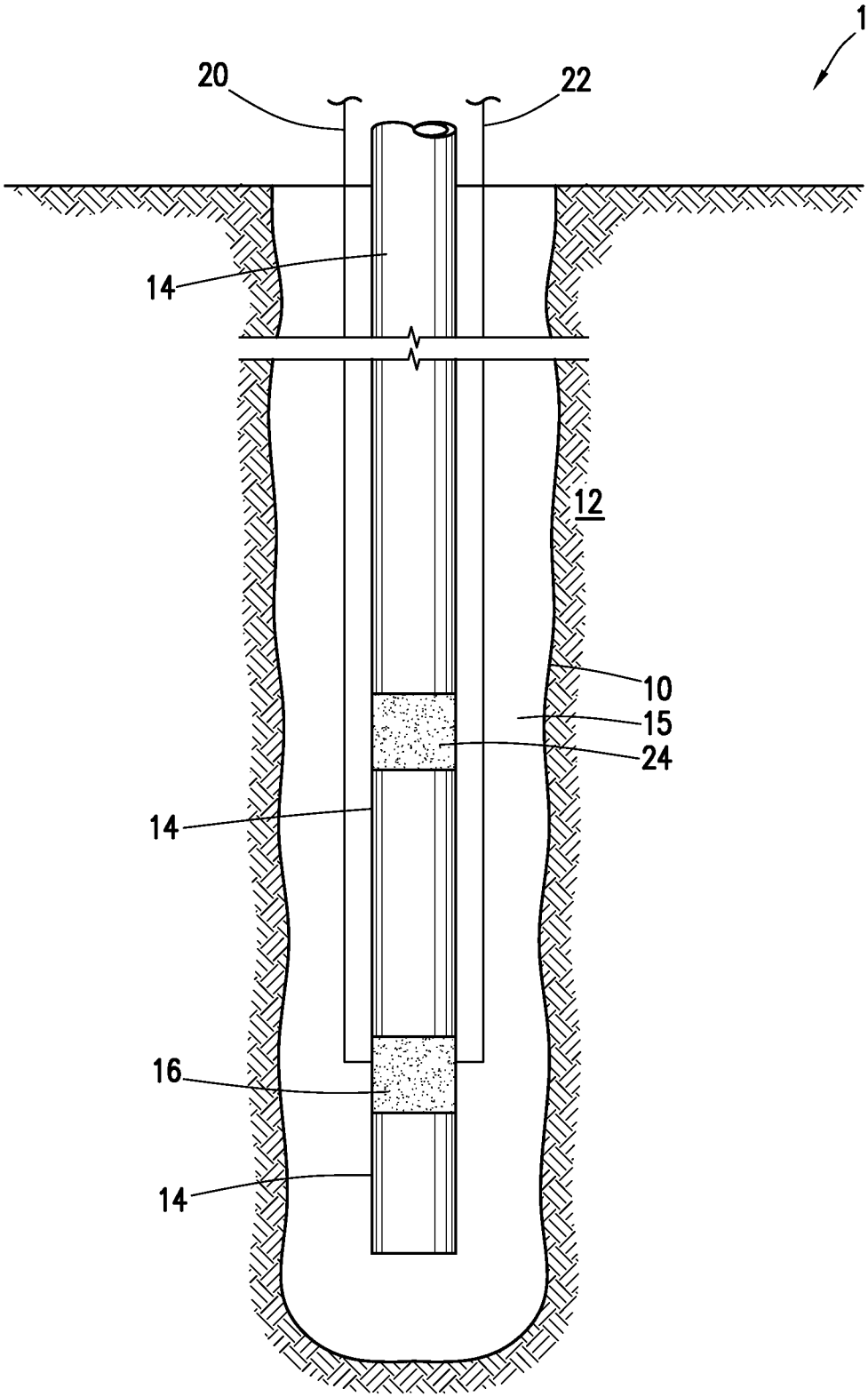
FIG. 1 shows an illustrative schematic of a wellbore system containing a tubing string having a tubing-retrievable safety valve attached thereto.

FIG. 1 shows an illustrative schematic of a wellbore system containing a tubing string having a tubing-retrievable safety valve attached thereto. The tubing-retrievable safety valve may represent a primary safety valve of the wellbore system. The terms "tubing-retrievable safety valve," "primary safety valve," and "safety valve" are synonymous and may be used interchangeably herein. In wellbore system 1, wellbore 10 penetrates subterranean formation 12. Although wellbore 10 is depicted as being substantially vertical in FIG. 1, it is to be recognized that one or more non-vertical sections may also be present and are fully consistent with the embodiments of the present disclosure. Tubing string 14 is disposed within at least a portion of the length of wellbore 10, with annulus 15 being defined between the exterior of tubing string 14 and the interior of wellbore 10. Tubing string 14 further defines an internal flowpath therethrough (not shown in FIG. 1). Safety valve 16 is interconnected to tubing string 14 and is configured to regulate fluid flow above and below safety valve 16 within the internal flowpath, including shutting off fluid access in the event of an emergency. Safety valve 16 may have at least one hydraulic line connected thereto (two shown in FIG. 1, e.g., control line 20 and balance line 22), as discussed in more detail below. Control line 20 and balance line 22 may extend from the earth's surface in order to allow operation of safety valve 16 to take place from a rig, wellhead installation, or subsea platform located on the earth's surface. Nipple 24 may also be arranged within an upper portion of tubing string 14. An insert safety valve may be positioned in nipple 24 and actuated, as discussed in further detail below.

Figures 2A, 2B:
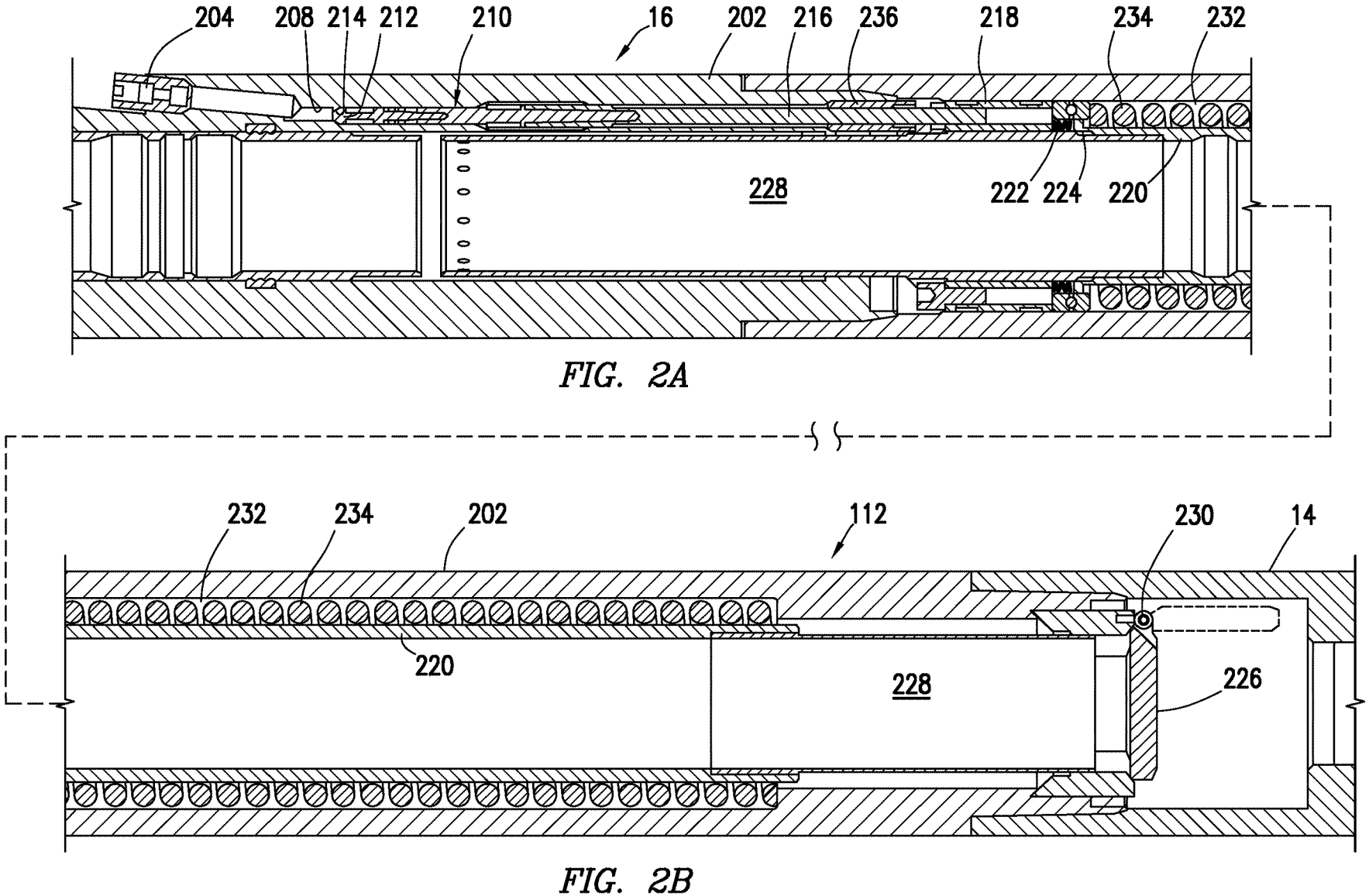
FIGS. 2A and 2B show detailed schematics of an illustrative tubing-retrievable safety valve that is operable by a single hydraulic control line.

FIGS. 2A and 2B show detailed schematics of an illustrative tubing-retrievable safety valve that is operable by a single hydraulic control line. With continued reference to FIG. 1, FIGS. 2A and 2B show progressive cross-sectional side views of illustrative safety valve 16 and its hydraulic operating mechanisms. FIG. 2A depicts an upper portion of safety valve 16 and FIG. 2B depicts a successive lower portion of safety valve 16. Safety valve 16 includes housing 202 that is coupled to tubing string 14 at opposing ends of housing 202 (tubing string 14 shown only in FIG. 2B).

Control line port 204 may be provided in housing 202 for connecting a hydraulic control line (not shown in FIG. 2A or 2B) to safety valve 16. When appropriately connected to control line port 204, the hydraulic control line establishes fluid communication with piston bore 208 defined in housing 202, thereby allowing hydraulic fluid pressure to be conveyed thereto. Piston bore 208 may be an elongate channel or conduit that extends substantially longitudinally along a portion of the axial length of safety valve 16.

Piston assembly 210 is arranged within piston bore 208 and is configured to translate axially therein. Piston assembly 210 includes piston head 212 that mates with and otherwise biases up stop 214 defined within piston bore 208 when piston assembly 210 is forced upwards. Up stop 214 may be a radial shoulder defined by housing 202 within piston bore 208, which has a reduced diameter and an axial surface configured to engage a corresponding axial surface of piston head 212. Up stop 214 may generate a mechanical metal-to-metal seal between the two components to prevent the migration of fluids (e.g., hydraulic fluids, production fluids, and the like) therethrough. Other configurations of up stop 214 that are configured to arrest axial movement of piston assembly 210 are also possible.

Piston assembly 210 may also include piston rod 216 that extends longitudinally from piston assembly 210 through at least a portion of piston bore 208. At a distal end of piston rod 216, it may be coupled to actuator sleeve 218 for affecting motion of flow tube 220. Flow tube 220 is movably arranged within safety valve 16. More particularly, actuator sleeve 218 may engage biasing device 222 (e.g., a compression spring, a series of Belleville washers, or the like) arranged axially between actuator sleeve 218 and actuation flange 224 that forms part of the proximal end of flow tube 220. As actuator sleeve 218 acts upon biasing device 222 with axial force, actuation flange 224 and flow tube 220 correspondingly move axially in the direction of the applied force (i.e., downward with increasing hydraulic pressure). Down stop 236 may be arranged within the piston bore 208 in order to limit the range of axial motion of piston assembly 210. A metal-to-metal seal may be created between piston assembly 210 and down stop 236 such that the migration of fluids (e.g., hydraulic fluids, production fluids, and the like) therethrough is generally prevented.

Safety valve 16 further includes flapper valve 226 that is selectively movable between open and closed positions to either prevent or allow fluid flow through internal flowpath 228 defined through the interior of safety valve 16. Flapper valve 226 is shown in FIG. 2B in its default, closed position such that fluid flow into internal flowpath 228 from downhole (i.e., to the right of FIG. 2B) is substantially blocked. At least one torsion spring 230 biases flapper valve 226 to pivot to its closed position.

Upon hydraulic pressurization and downward movement of piston rod 216, flow tube 220 is also displaced downward, eventually overcoming the force associated with torsion spring 230 and any associated downhole fluid pressures. At this point, flapper valve 226 moves from its closed position to an open position (shown in phantom in FIG. 2B). When the hydraulic pressure is released, flow tube 220 is displaced upwardly and the spring force of torsion spring 230 moves flapper valve 226 back to its closed position.

Safety valve 16 may further contain lower chamber 232 within housing 202. In some embodiments, lower chamber 232 may form part of piston bore 208, such as being an elongate extension thereof. Power spring 234, such as a coil or compression spring, may be arranged within lower chamber 232 and correspondingly biases actuation flange 224 and actuation sleeve 218 upwardly, which, in turn, also biases piston assembly 210 in the same direction. That is, power spring 234 also resists the hydraulic pressure applied from the hydraulic control line and helps to prevent flapper valve 226 from being opened inadvertently. Accordingly, expansion of the power spring 234 causes piston assembly 210 to move upwardly within piston bore 208. It should be noted that in addition to power spring 234, other types of biasing devices, such as a compressed gas with appropriate sealing mechanisms, may be employed similarly.

As mentioned above, a hydraulic control line may provide hydraulic pressurization to safety valve 16 at control line port 204. However, more than one hydraulic line may be present in certain types of safety valves. For example, referring again to FIG. 1, safety valve 16 may be controllable by dual hydraulic lines, such as control line 20 and balance line 22. The DEPTHSTAR® tubing-retrievable safety valve from Halliburton Energy Services, Inc. represents an illustrative example of a safety valve that is controllable by dual hydraulic lines. Control line 20 may provide for hydraulic pressurization of safety valve 16 in a manner similar to that described above in reference to FIGS. 2A and 2B. That is, hydraulic pressurization of control line 20 may force a flow tube downward to open safety valve 16. In contrast, hydraulic pressurization of balance line 22 may tend to force the flow tube upwardly. That is, balance line 22 counteracts the hydraulic pressurization provided by control line 20 and further supplements the upward forces tending to keep safety valve 16 closed.

As depicted in FIG. 1, control line 20 and balance 22 extend to safety valve 16 within annulus 15, in close proximity to tubing string 14. However, other configurations for control line 20 and balance line 22 are also possible. In alternative configurations, for instance, control line 20 and/or balance line 22 may be located in the internal flowpath of tubing string 14 or be defined, at least in part, in a sidewall of tubing string 14 or a component thereof (e.g., within the sidewall of nipple 24). Regardless of their particular configuration, control line 20 and balance line 22 allow safety valve 16 to be controlled hydraulically from the earth's surface.

As discussed above, failure of control line 20 or balance line 22 can render safety valve 16 at least partially inoperable. Failure of control line 20 can be particularly detrimental, since failure of this line leads to an inability to maintain safety valve 16 in an open position. Similarly, failure of safety valve 16 itself (e.g., due to corrosion or scaling) may prevent effective hydraulic control from taking place. To address the foregoing issues associated with an inoperable safety valve, hydraulic communication with safety valve 16 may be discontinued and hydraulic control may be transferred to an insert (secondary) safety valve that is located above safety valve 16 within tubing string 14, as discussed herein. The insert safety valve may be placed or inserted within tubing string 14 after the primary safety valve 16 has failed, specifically within the internal flow pathway (bore) of nipple 24. Accordingly, the term "insert safety valve" will be used herein to refer to a secondary safety valve that is used to replace or otherwise supplement an inoperative primary safety valve. The terms "insert safety valve" and "secondary safety valve" may be used interchangeably herein. These safety valves are not considered to be a redundant backup of the primary safety valve, but are instead placed in-line to supplant a failed primary safety valve by establishing a new hydraulic flow pathway. Effective replacement of a primary safety valve with an insert safety valve can allow production of wellbore fluids to continue without conducting an expensive and time-consuming workover operation to withdraw tubing string 14 for valve repair or replacement. Advantageously, the disclosure herein allows existing control lines and balance lines to be used for regulating the insert safety valve, rather than utilizing one or more new lines and increasing the number of penetrations through a tubing hanger.

With reference again being made to FIG. 1, an insert safety valve may be positioned in an internal flowpath defined within nipple 24, which comprises a portion of tubing string 14 above safety valve 16. Specifically, the internal flowpath may comprise the bore of nipple 24 and any profile features defined therein. The profile features within the bore may allow the insert safety valve to be properly seated and retained therein. For example, nipple 24 may comprise a landing shoulder or threading within the bore for proper seating of the insert safety valve. Safety valve 16 and the insert safety valve contained with nipple 24 may be separated by any distance, which may range from inches to thousands of feet.

According to various embodiments of the present disclosure, nipple 24 is configured such that hydraulic control of the insert safety valve can be established using control line 20 and balance line 22, once hydraulic control of safety valve 16 has been discontinued. Nipple 24 may be further configured to promote shutting off hydraulic communication with safety valve 16. Once hydraulic control of the insert safety valve in nipple 24 has been established, operation of this valve may take place in a manner substantially similar to that originally used for operating safety valve 16. That is, opening and closing of the insert safety valve may take place through appropriately pressurizing and de-pressurizing control line 20 and balance line 22. Advantageously, the embodiments of the present disclosure allow both control line 20 and balance line 22 to be used in operating the insert safety valve, thereby maintaining the desirable features afforded by the use of dual hydraulic lines in safety valve 16. However, single-line insert safety valves may also be used in a related manner.

In order for hydraulic control to be transferred to the insert safety valve in the foregoing manner, control line 20 and balance line 22 are placed in latent fluid communication with nipple 24 (latent fluid communication not shown in FIG. 1), particularly the internal flow pathway of nipple 24. In this regard, control line 20 and balance line 22 may be coupled with corresponding ports defined on the exterior of nipple 24, or at least a portion of control line 20 and balance line 22 may be defined within the sidewall of nipple 24, where latent hydraulic lines are further present. As used herein, the term "latent hydraulic lines" will refer to hydraulic lines that may become hydraulically pressurized upon the occurrence of a triggering event within a wellbore system. Under normal operational conditions (i.e., when safety valve 16 is still functional), hydraulic pressurization actuates safety valve 16 and bypasses the latent hydraulic lines in nipple 24. That is, under normal operational conditions, hydraulic fluid simply passes through control line 20 and balance line 22 without initiating any appreciable transference of the hydraulic pressurization to the latent hydraulic lines within nipple 24. The hydraulic fluid may pass through nipple 24 in performing this action, but without accessing the latent hydraulic lines. The embodiments of the present disclosure describe various ways in which nipple 24 may be configured to bypass lower portions of control line 20 and balance line 22, each leading to safety valve 16, and to activate the latent hydraulic lines therein for operating an insert safety valve. More particularly, the present disclosure describes various configurations whereby pressurization above a threshold hydraulic pressure may promote activation of the latent hydraulic lines within nipple 24.

In some embodiments, nipple 24 may be configured such that over-pressurization of at least one of control line 20 or balance line 22 results in a switch to the latent hydraulic lines in nipple 24. Over-pressurization may occur between a normal maximum operating pressure of these lines and their failure or bursting pressure. Specifically, control line 20 and balance line 22 may each contain a pressure-actuated device that is in fluid communication with these lines and initially blocks hydraulic access to the latent hydraulic lines within nipple 24. Upon over-pressurizing at least one of control line 20 and balance line 22, the pressure-actuated device activates and promotes switching to the latent hydraulic lines within nipple 24. That is, upon activation of the pressure-actuated device, hydraulic fluid gains access to at least a portion of the latent hydraulic lines within nipple 24.

In a first configuration, discontinuation of hydraulic communication with safety valve 16 may occur through sequential over-pressurization of control line 20 and balance line 22. Either control line 20 or balance line 22 may be over-pressurized first to affect switching of the other, depending upon which line is presently operative and capable of being pressurized. The over-pressurization of a first line may actuate a switching mechanism within nipple 24 that shuts off hydraulic communication between the opposing line and safety valve 16 and also activates a latent hydraulic line within nipple 24. By subsequently over-pressurizing the opposing line, closure of the first line may be affected and the remaining latent hydraulic lines may be activated. The activated latent hydraulic lines in nipple 24 can then be used to regulate the operation of an insert safety valve placed therein. Provided that at least one of control line 20 or balance line 22 remains intact below nipple 24 and can be over-pressurized, both lines may be switched to discontinue hydraulic communication with safety valve 16 and to activate the latent hydraulic lines within nipple 24. Further details in this regard are provided below.

Figure 3A:
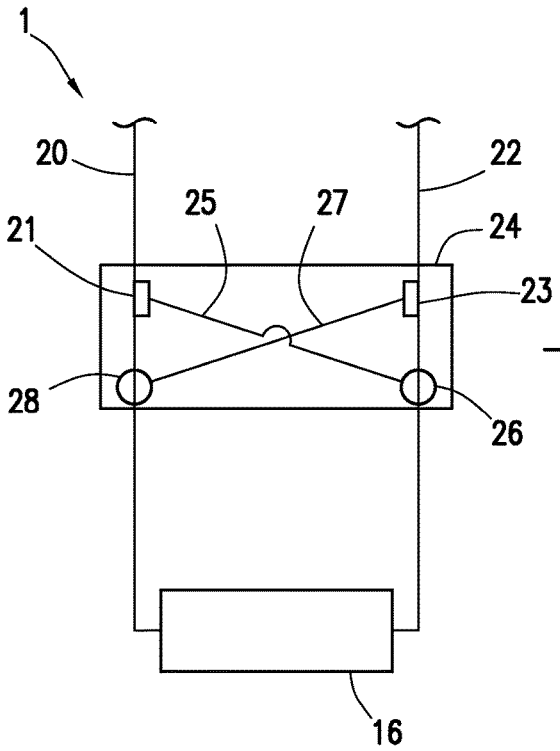
FIGS. 3A-3D show illustrative schematics demonstrating how sequential over-pressurization of a control line and a balance line may discontinue hydraulic communication with a safety valve.

FIGS. 3A-3D show illustrative schematics demonstrating how sequential over-pressurization of a control line and a balance line may discontinue hydraulic communication with a safety valve. FIG. 3A shows the normal operational state of wellbore system 1, in which both control line 20 and balance line 22 maintain effective hydraulic communication with safety valve 16. Control line 20 and balance line 22 each traverse nipple 24 and extend downwardly to safety valve 16 to establish hydraulic communication therewith. As discussed above, control line 20 and balance line 22 need not necessarily reside within nipple 24, but they may still establish hydraulic communication with nipple 24 in an alternative manner. Crossover hydraulic line 25 extends from control line 20 to balance line 22, with pressure-actuated device 21 intervening in between. Similarly, crossover hydraulic line 27 extends from balance line 22 to control line 20, with pressure-actuated device 23 intervening between the two. The locations of pressure-actuated devices 21 and 23 relative to control line 20 and balance line 22 are arbitrary, and the depicted configuration should not be considered limiting. Switching mechanisms 26 and 28 are in hydraulic communication with crossover hydraulic lines 25 and 27, respectively. Switching mechanisms 26 and 28 are also configured to regulate the passage of hydraulic fluid through balance line 22 and control line 20, respectively. Upon actuation of switching mechanisms 26 and 28, hydraulic control can be discontinued below nipple 24 and instead become established in nipple 24 via latent hydraulic lines (discussed below). The latent hydraulic lines are in fluid communication with the original portions of control line 20 and balance line 22 that lead to the earth's surface, thereby allowing an insert safety valve to be regulated therefrom. Disclosure regarding suitable pressure-actuated devices 21 and 23 and switching mechanisms 26 and 28 is provided hereinbelow.

In the interest of clarity, the disposition of nipple 24 and safety valve 16 within a tubing string are not depicted in FIGS. 3A-3D. A configuration similar to that depicted in FIG. 1 may be used in some embodiments, although other configurations are certainly possible. Likewise, an insert safety valve is not depicted within nipple 24 in the interest of clarity.

Figure 3B:
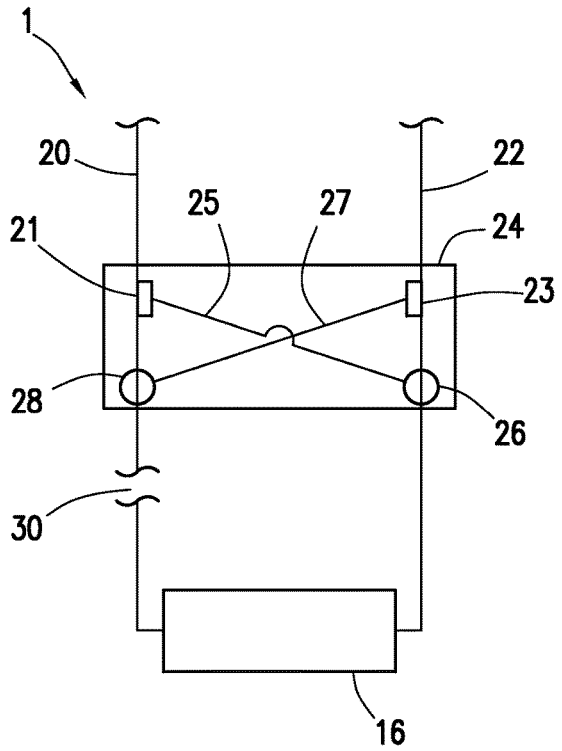
Figure 3D:
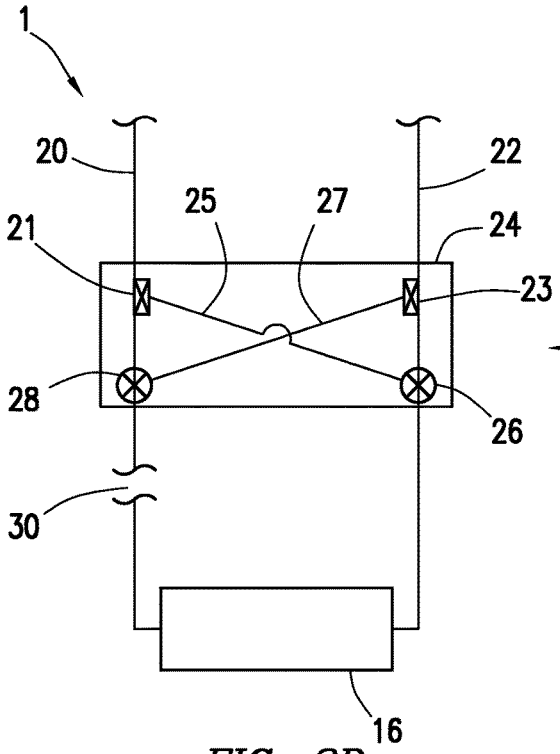
Figure 3C:
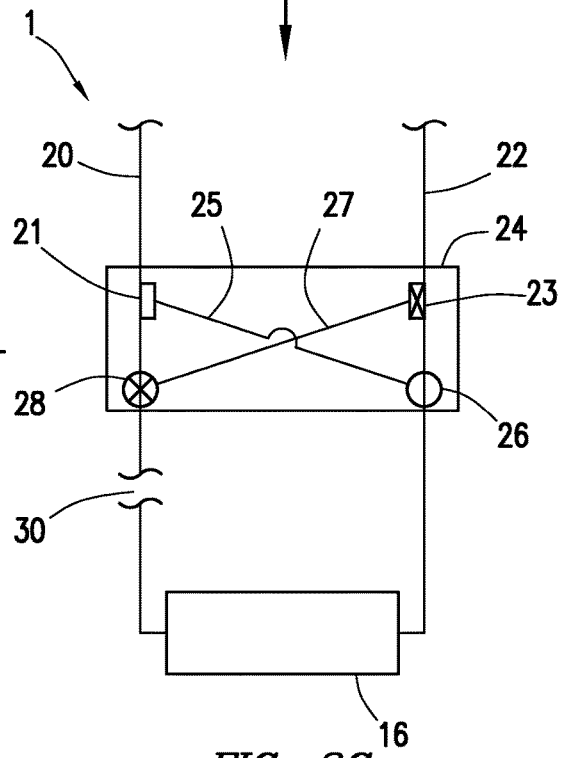

FIGS. 3B-3D show wellbore system 1 after its normal operational state has been disrupted due to breach 30 in control line 20 at a location below nipple 24 and above safety valve 16. Once control line 20 has been breached, normal hydraulic control of safety valve 16 from the earth's surface is no longer possible. In FIG. 3B, neither control line 20 nor balance line 22 has been redirected to access latent hydraulic lines in nipple 24. At this juncture, control line 20 is essentially non-pressurizable due to the presence of breach 30.

FIG. 3C shows how over-pressurization of balance line 22 can redirect control line 20 to access latent hydraulic lines within nipple 24, thereby shutting off control line 20 below nipple 24 and rendering breach 30 inconsequential. Specifically, over-pressurization of balance line 22 actuates pressure-actuated device 23, thereby resulting in hydraulic pressurization of crossover hydraulic line 27. Pressurization of crossover hydraulic line 27, in turn, actuates switching mechanism 28, which shuts off control line 20 below nipple 24. At this point, balance line 22 remains in hydraulic communication with safety valve 16.

Once switching mechanism 28 has been actuated and the lower portion of control line 20 has been shut off, control line 20 may once again be hydraulically pressurized from the earth's surface. Hydraulic pressurization of control line 20 at this juncture may allow at least a portion of the latent hydraulic lines within nipple 24 to be accessed. Further, in order to redirect hydraulic control of balance line 22 into nipple 24 and to shut off a lower portion of balance line 22, control line 20 may be over-pressurized in a similar manner to that described above. Specifically, upon over-pressurization of control line 20, both pressure-actuated device 21 and switching mechanism 26 actuate to shut off the portion of balance line 22 below nipple 24, as depicted in FIG. 3D.

Upon re-directing both control line 20 and balance line 22 to access latent hydraulic lines within nipple 24, thereby shutting off safety valve 16 in the process, an insert safety valve may be lowered into the wellbore and positioned within the bore of nipple 24. Suitable techniques for positioning an insert safety valve within nipple 24, such as through wireline, braided line, or coiled tubing deployment, will be familiar to one having ordinary skill in the art. Before or after placing the insert safety valve, safety valve 16 may be mechanically locked in an open position such that it is permanently bypassed within the tubing string, thereby turning its fluid control function over to the insert safety valve. The insert safety valve may be operated in a substantially similar manner to that of safety valve 16 by pressurizing and depressurizing control line 20 and balance line 22 in a desired way. In alternative embodiments, a single-line insert safety valve may be used as an alternative to a dual-line safety valve, and such valves may be inserted after actuating only a single line (such as in the configuration of FIG. 3C, with either control line 20 or balance line 22 being over-pressurized to actuate the insert safety valve). Furthermore, the insert safety valve may be of a similar design to that of safety valve 16 that it replaces (e.g., they may both be flapper-type valves), or they may also be of dissimilar designs. For example, the mechanism for actuating the flapper may differ in some manner between safety valve 16 and the insert safety valve. Likewise, in some configurations referenced above, safety valve 16 may be regulated with dual lines, whereas the insert safety valve is only regulated with a single line.

Although FIGS. 3B-3D have depicted breach 30 as being present within control line 20, it is to be recognized that a breach within balance line 22 may be addressed in a similar manner. Specifically, a breach within balance line 22 may be addressed by over-pressurizing control line 20 to shut off the lower portion of balance line 22 and then over-pressurizing balance line 22 to shut off a lower portion of control line 20 (i.e., by reversing the operations depicted in FIGS. 3C and 3D). Again, as long as at least one of control line 20 or balance line 22 can be effectively pressurized, switching of the hydraulic control from safety valve 16 to an insert safety valve may take place through over-pressurization in the manner described above. For insert safety valves that are regulated with just a single hydraulic line, only the initially inoperative line may need to be switched in order to operate the insert safety valve.

In still another alternative, the operations described above in reference to FIGS. 3C and 3D may also be applied for redirecting hydraulic control from safety valve 16 when it has failed for reasons unrelated to breaching of control line 20 or balance line 22. That is, the description above is equally applicable when control line 20 and balance line 22 remain intact and safety valve 16 has failed in some other manner (e.g., fouling due to corrosion or scaling). When both control line 20 and balance line 22 remain intact, either line may be over-pressurized first to redirect hydraulic control of the opposing line to within nipple 24.

Pressure-actuated devices 21 and 23 suitable for use in the embodiments described herein are not considered to be particularly limited and may include both pressure-relief valves that are actuatable multiple times or single-use devices, such as rupture discs. Pressure-relief valves that are actuatable multiple times may allow the crossover hydraulic pressurization to be discontinued once control line 20 and balance line 22 have been switched, which may be advantageous in certain instances. In either case, pressure-actuated devices 21 and 23 prevent pressurization of crossover hydraulic lines 25 and 27 from occurring until a threshold pressure value has been exceeded in control line 20 or balance line 22, as described above.

Switching mechanisms 26 and 28 may include any structure that is responsive to hydraulic pressure within crossover hydraulic lines 25 and 27, thereby allowing control line 20 and balance line 22 to be shut off below nipple 24. Suitable switching mechanisms 26 and 28 allow control line 20 and balance line 22 to remain open during normal operational conditions but become permanently closed once a threshold hydraulic pressure has been exceeded in crossover hydraulic lines 25 and 27, even after these lines are no longer over-pressurized. In addition, suitable switching mechanisms 26 and 28 may allow latent hydraulic lines within nipple 24 to become functional by connecting them to control line 20 and balance line 22, so that an insert safety valve within nipple 24 can be operated hydraulically by appropriately pressurizing and depressurizing control line 20 and balance line 22.

In some embodiments, switching mechanisms 26 and 28 may comprise a valve that permanently closes upon pressurization of crossover hydraulic lines 25 and 27. Valves suitable for this purpose will be familiar to one having ordinary skill in the art. In related embodiments, switching mechanisms 26 and 28 may comprise a piston within crossover hydraulic lines 25 and 27. In such embodiments, the piston may displace upon over-pressurization and initiate blocking fluid flow in control line 20 or balance line 22 below nipple 24, thereby allowing an upper portion of the line to be subsequently over-pressurized as described above. The piston may be locked in place upon being displaced in order to affect permanent closure of control line 20 and balance line 22.

In other embodiments, switching mechanisms 26 and 28 may comprise a normal valve that is propped open under standard operational conditions but closes in response to pressurization of crossover hydraulic lines 26 and 28. Normal valves that may be propped open under standard operational conditions include, for example, poppet-controlled valves, and ball valves. The mechanism by which the valve is propped open and subsequently closed will be dependent upon the type of valve, and such suitable mechanisms will be familiar to one having ordinary skill in the art.

In other illustrative embodiments, switching mechanism 26 or 28 may provide temporary closure within control line 20 or balance line 22 when the opposing line is being over-pressurized, and complete closure may occur upon over-pressurizing the now-closed line to promote closure within the originally over-pressurized line. For example, over-pressurization of a first line (e.g., balance line 22) may affect temporary closure of the opposing line (e.g., control line 20) and actuate a returnable blocking mechanism (e.g., a spring-loaded piston) within the first line. Upon over-pressurization of the temporarily closed opposing line (e.g., control line 22), it may become permanently closed by locking its switching mechanism into place. Temporary closure of the first line (e.g., balance line 22) may also occur upon over-pressurization of the opposing line. Subsequently, the first line may be permanently closed through over-pressurization of that line to lock its switching mechanism into place. An advantage of this approach is that an inadvertently over-pressurized line need not necessarily be permanently taken out of service. Suitable valves and like switching mechanisms for affecting temporary line closure will again be familiar to one having ordinary skill in the art.

In still other embodiments, switching mechanisms 26 and 28 may comprise one or more hydraulic spools that are configured to move in one or more switching chambers within nipple 24 in response to increased hydraulic pressure within crossover hydraulic lines 25 and 27. Such hydraulic spools may be configured to divert hydraulic fluid from control line 20 and balance line 22 to latent hydraulic lines within nipple 24, such that an insert safety valve placed within nipple 24 can be hydraulically controlled. As discussed further hereinbelow, hydraulic spools may also be actuated through over-pressurization originating from sources other than within control line 20 or balance line 22.

Figure 4A:
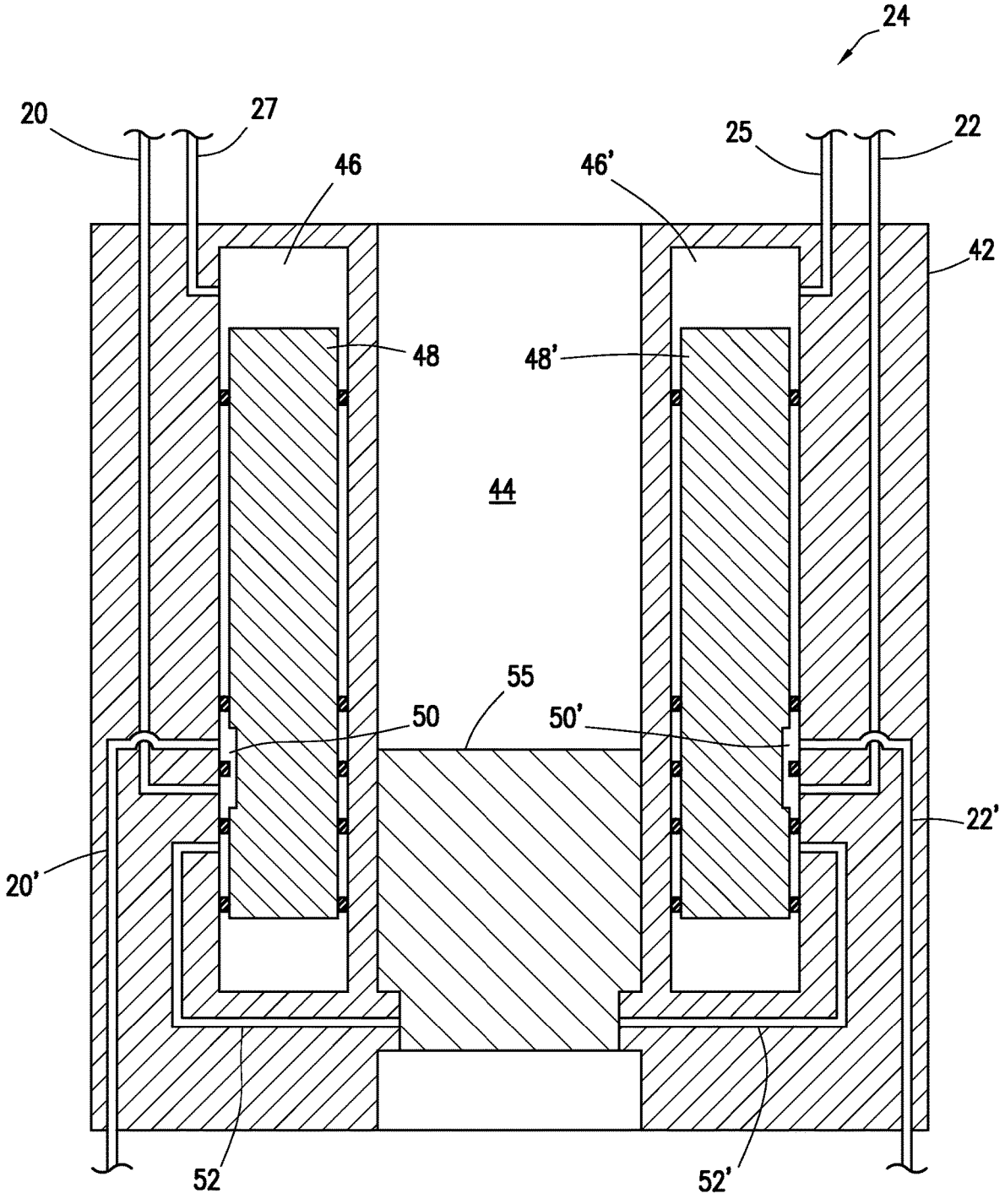
FIGS. 4A-4D show schematics of illustrative nipples containing one or more hydraulic spools and latent hydraulic lines.
Figure 4B:
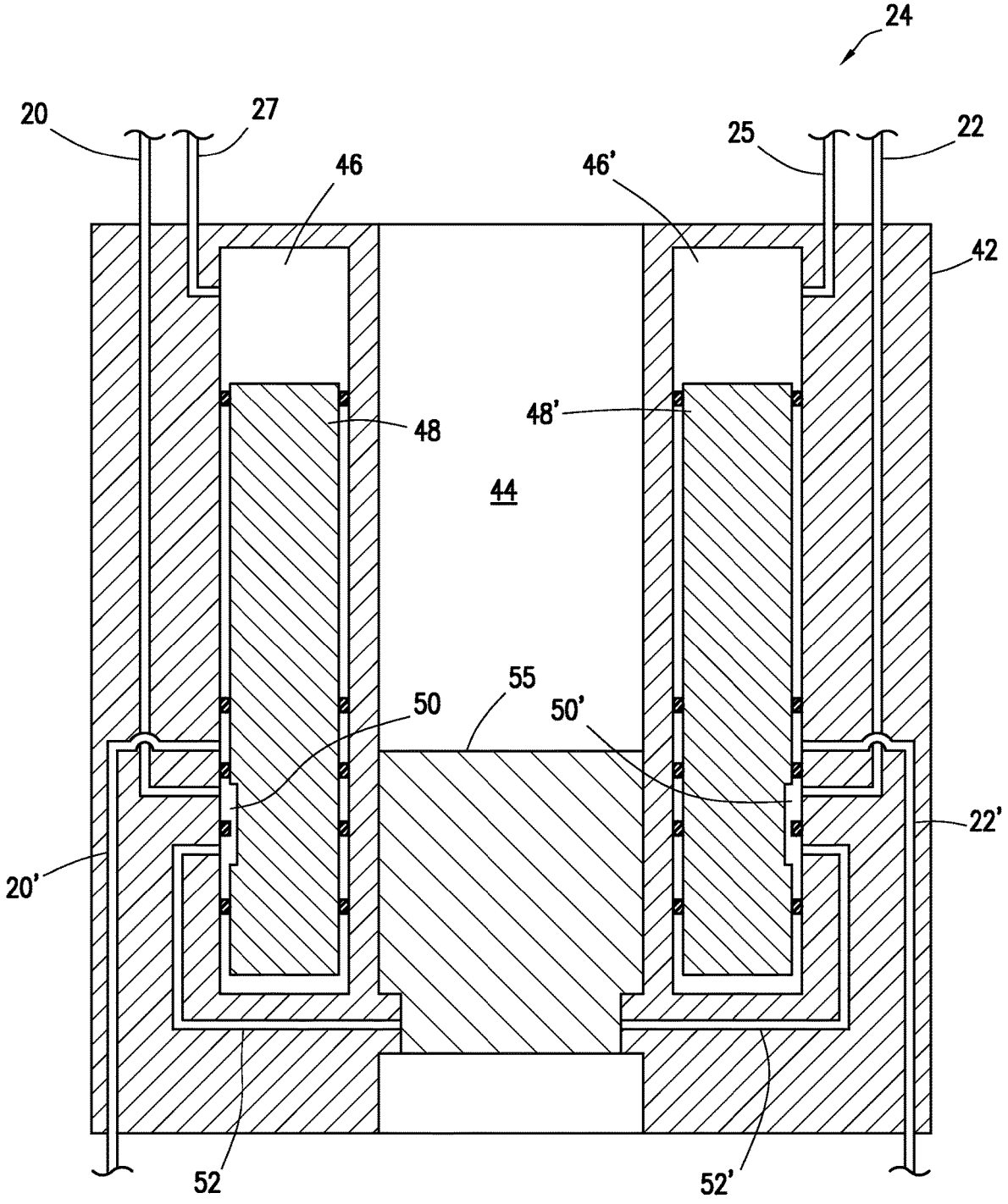

FIGS. 4A-4D show schematics of illustrative nipples containing one or more hydraulic spools and latent hydraulic lines. FIGS. 4A and 4B show a nipple configuration in which separate hydraulic spools 48 and 48' are utilized to provide sequential switching of control line 20 and balance line 22, respectively. As shown, nipple 24 includes housing 42 and bore 44. Insert safety valve 55 can be placed within bore 44 at a desired time. Switching chambers 46 and 46' are defined within housing 42, and hydraulic spools 48 and 48' are disposed within switching chambers 46 and 46', respectively. Hydraulic spools 48 and 48' each contain recess 50 and 50' through which hydraulic fluid from control line 20 or balance line 22 may pass during operation to actuate a tubing-retrievable safety valve (primary safety valve) or insert safety valve 55 (secondary safety valve). In alternative embodiments, however, instead of a recess within hydraulic spools 48 and 48', a conduit may extend laterally across hydraulic spools 48 and 48' or longitudinally along hydraulic spools 48 and 48' to allow fluid communication to occur in a similar manner. Alternately, hydraulic spools 48 and 48' may have a reduced cross-sectional area in the regions where fluid flow is intended to occur and an increased cross-sectional area where it is not. Crossover hydraulic line 25 extends to a headspace of switching chamber 46' above hydraulic spool 48', and crossover hydraulic line 27 extends to a headspace of switching chamber 46 above hydraulic spool 48. Again, in the interest of clarity, a primary safety valve is not depicted in FIGS. 4A-4D, nor is an associated tubing string depicted.

Under normal operational conditions (FIG. 4A), spools 48 and 48' are retained in a first configuration, in which crossover hydraulic lines 25 and 27 are substantially unpressurized and latent hydraulic lines 52 and 52' are inactive. Retention of spools 48 and 48' within switching chambers 46 and 46', respectively, may take place mechanically through any combination of friction, shear ring or shear pin retention, or the like, with the retention force being overcome upon over-pressurization such that spools 48 and 48' move to a second configuration for operating insert safety valve 55. Accordingly, in the configuration of FIG. 4A, the primary safety valve may still be operated through hydraulic pressurization of control lines 20 and 20' and balance lines 22 and 22' without triggering a premature conversion to the second configuration. Control line 20' essentially represents an extension of control line 20 with recess 50 intervening in between, and balance line 22' essentially represents an extension of balance line 22 with recess 50' intervening in between. Recesses 50 and 50' (or similar conduits through hydraulic spool 48 and 48') allow hydraulic fluid to pass therethrough from a first portion of an attached hydraulic line to the next. Control line 20' and balance line 22' lead to the primary safety valve. Accordingly, under normal operational conditions, hydraulic fluid simply passes from control line 20, through recess 50 and into control line 20' to affect control of the primary safety valve. Similar hydraulic pressurization takes place in balance lines 22 and 22' via recess 50'. Recesses 50 and 50' have seals, such as one or more O-ring seals or other similar type of sealing mechanism, disposed laterally upon either side in the switched and unswitched configurations. Under the normal operational configuration of FIG. 4A, latent hydraulic lines 52 and 52', which are configured to affect hydraulic control of insert safety valve 55 upon their activation, are not in fluid communication with control line 20 and balance line 22, respectively. That is, under normal operational conditions, hydraulic control has not yet been transferred to nipple 24.

As shown in FIG. 4B, latent hydraulic lines 52 and 52' may become activated for affecting hydraulic pressurization by moving hydraulic spools 48 and 48' downward. Specifically, by sequentially applying hydraulic pressure to switching chambers 46 and 46' from crossover hydraulic lines 25 and 27, hydraulic spools 48 and 48' can be shifted downward in response to the increased hydraulic pressure. Upon shifting hydraulic spools 48 and 48' downward, control lines 20 and 20' and balance lines 22 and 22' are no longer in hydraulic communication with one another via recesses 50 and 50'. Instead, control line 20 is now in hydraulic communication with latent hydraulic line 52 via recess 50, and balance line 22 is now in hydraulic communication with latent hydraulic line 52' via recess 50'. A series of seals may be positioned around both sides of recesses 50 and 50' to provide for effective pressurization in both displacement states. Suitable seals may include, but are not limited to, O-rings, chevron seals, T-seals and the like, numerous examples of which will be familiar to one having ordinary skill in the art. Accordingly, hydraulic control may be transferred to within nipple 24, with insert safety valve 55 being hydraulically regulated via control line 20 and corresponding latent hydraulic line 52, and by balance line 22 and corresponding latent hydraulic line 52'.

Although FIGS. 4A and 4B have indicated single recesses 50 and 50' upon hydraulic spools 48 and 48', it is to be recognized that multiple recesses may instead be present to affect switching. For example, control lines 20 and 20' (or balance lines 22 and 22') may reside in a first recess before switching occurs, and control line 20 and corresponding latent hydraulic line 52 (or balance line 22 and corresponding latent hydraulic line 52') may reside in a second recess after switching occurs. Whether single or multiple recesses are present in a given hydraulic spool may be impacted by various design parameters such as, for example, the distance the hydraulic spool is to be moved downward to access a corresponding latent hydraulic line.

Figure 4C:
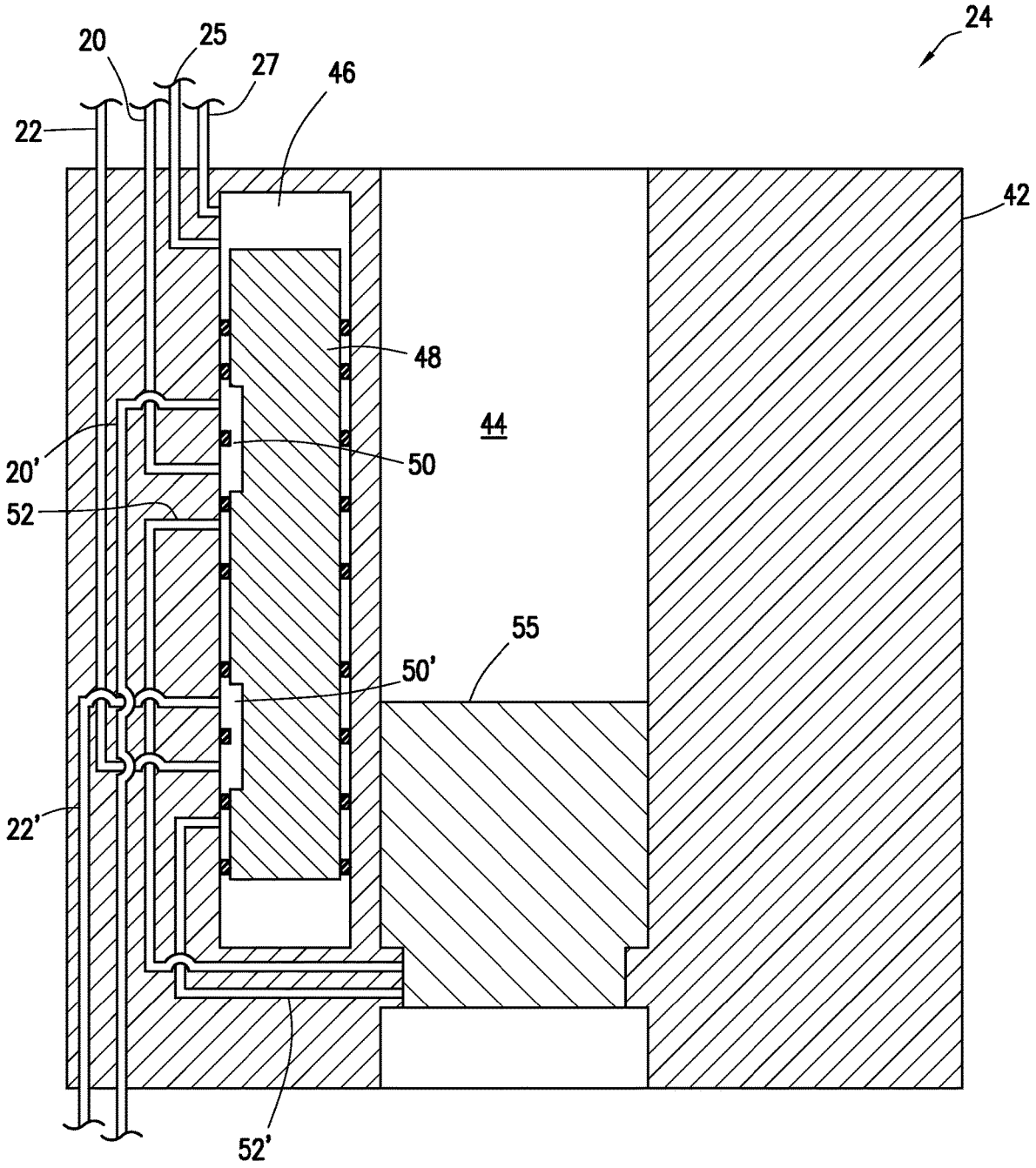

In related embodiments, over-pressurization of either control line 20 or balance line 22 may be used to affect simultaneous switching of both lines to nipple 24 as well as activation of latent hydraulic lines 52 and 52'. Specifically, as shown in FIG. 4C, the features to affect switching may be directed upon a single hydraulic spool. Again, provided that at least one of control line 20 or balance line 22 can be over-pressurized, hydraulic spool 48 can be shifted downward to transfer hydraulic control to nipple 24.

Figure 4D:
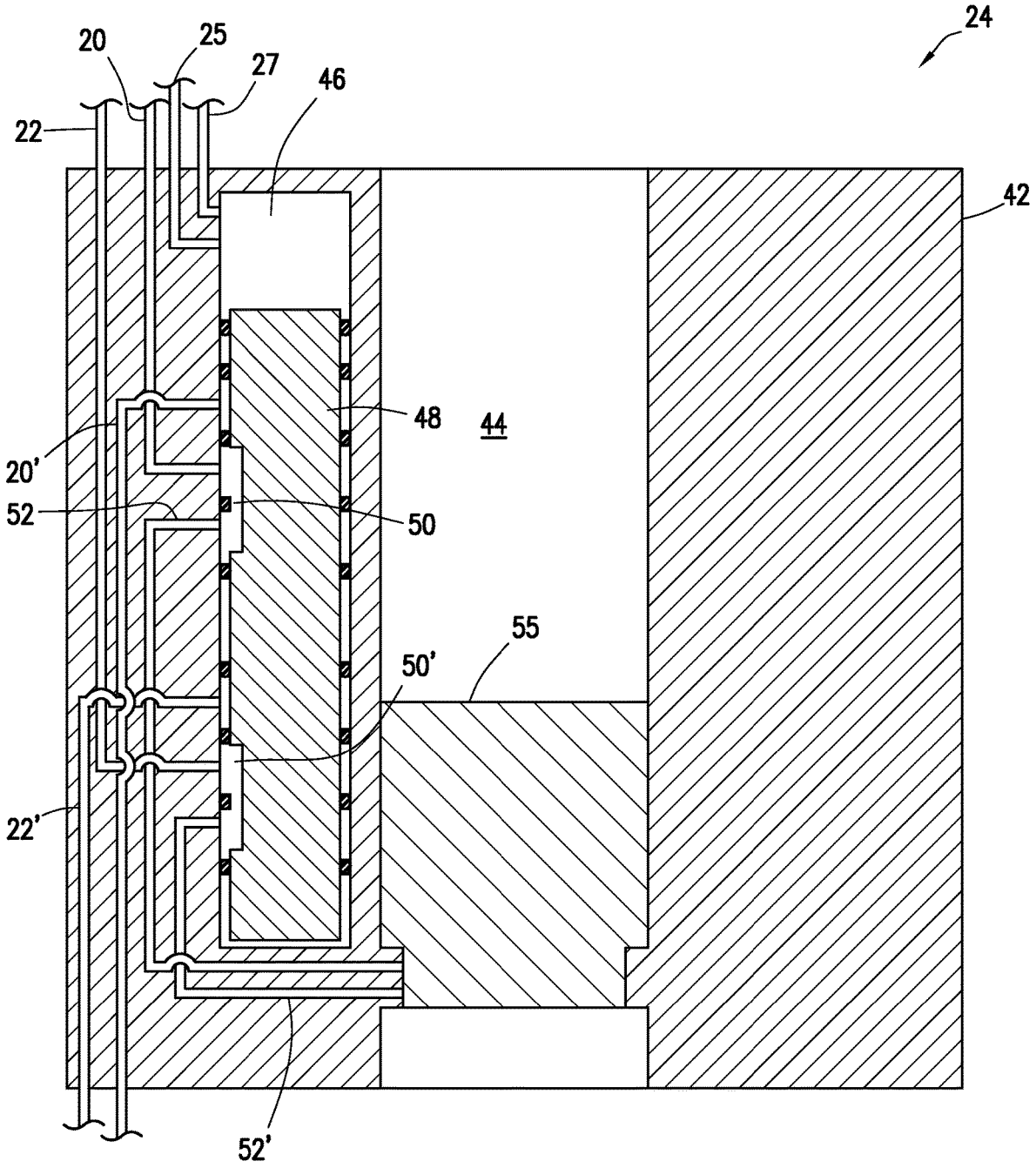

FIGS. 4C-4D show schematics of an illustrative nipple configuration that may affect simultaneous switching of a control line and a balance line from a primary safety valve to an insert safety valve. As shown, nipple 24 includes housing 42 and bore 44. Within bore 44, insert safety valve 55 can be placed at a desired time. Switching chamber 46 is defined within housing 42, and hydraulic spool 48 is disposed therein. Hydraulic spool 48 contains recesses 50 and 50' therein through which hydraulic fluid from control line 20 or balance line 22 may pass. Crossover hydraulic lines 25 and 27 extend to a headspace of switching chamber 46 above hydraulic spool 48.

Unlike the nipple configuration of FIGS. 4A and 4B, in which sequential over-pressurization of control line 20 and balance line 22 may affect switching to nipple 24 and activation of latent hydraulic lines 52 and 52', the nipple configuration of FIGS. 4C and 4D may initiate switching of both lines at the same time upon over-pressurization of either line. As in FIG. 4A, control lines 20 and 20' and balance lines 22 and 22' are initially in hydraulic communication with a primary safety valve under normal operational conditions, and latent hydraulic lines 52 and 52' are inactive. Upon over-pressurizing either control line 20 or balance line 22, hydraulic spool 48 moves downward to shut off access of hydraulic fluid to control line 20' via recess 50 and to balance line 22' via recess 50'. Contemporaneously, latent hydraulic lines 52 and 52' gain access to hydraulic fluid in recesses 50 and 50', respectively, and become active, thereby allowing hydraulic control of insert safety valve 55 to be realized. Again, it is to be recognized that control line 20 and balance line 22 may reside in different recesses before and after switching, instead of in the same recess 50 or 50' as depicted. The switched configuration is shown in FIG. 4D.

Although FIGS. 4C and 4D have depicted hydraulic spool 48 and associated recesses 50 and 50' as being located upon a single side of housing 42, it is also to be recognized that hydraulic spool 48 may be cylindrical in nature and be disposed circumferentially within the sidewall of nipple 24. Switching chamber 46 may similarly be disposed circumferentially within the sidewall of nipple 24. Accordingly, recesses 50 and 50' may be offset on opposing sides of hydraulic spool 48, and any lines extending thereto may also be disposed upon opposing sides of housing 42 as a result. Accordingly, the depicted configuration of FIGS. 4C and 4D should not be seen as limiting.

In yet another related embodiment, nipple 24 may be configured such that over-pressurization of either control line 20 or balance line 22 affects simultaneous switching of both lines to within nipple 24, but without employing crossover hydraulic lines between control line 20 and balance line 22. Unlike the nipple configurations of FIGS. 3A-3D and 4A-4D, in which crossover hydraulic lines 25 and 27 exist between control line 20 and balance line 22, the nipple configuration of FIGS. 5A and 5B may achieve direct switching of these lines through over-pressurization.

Figure 5A:
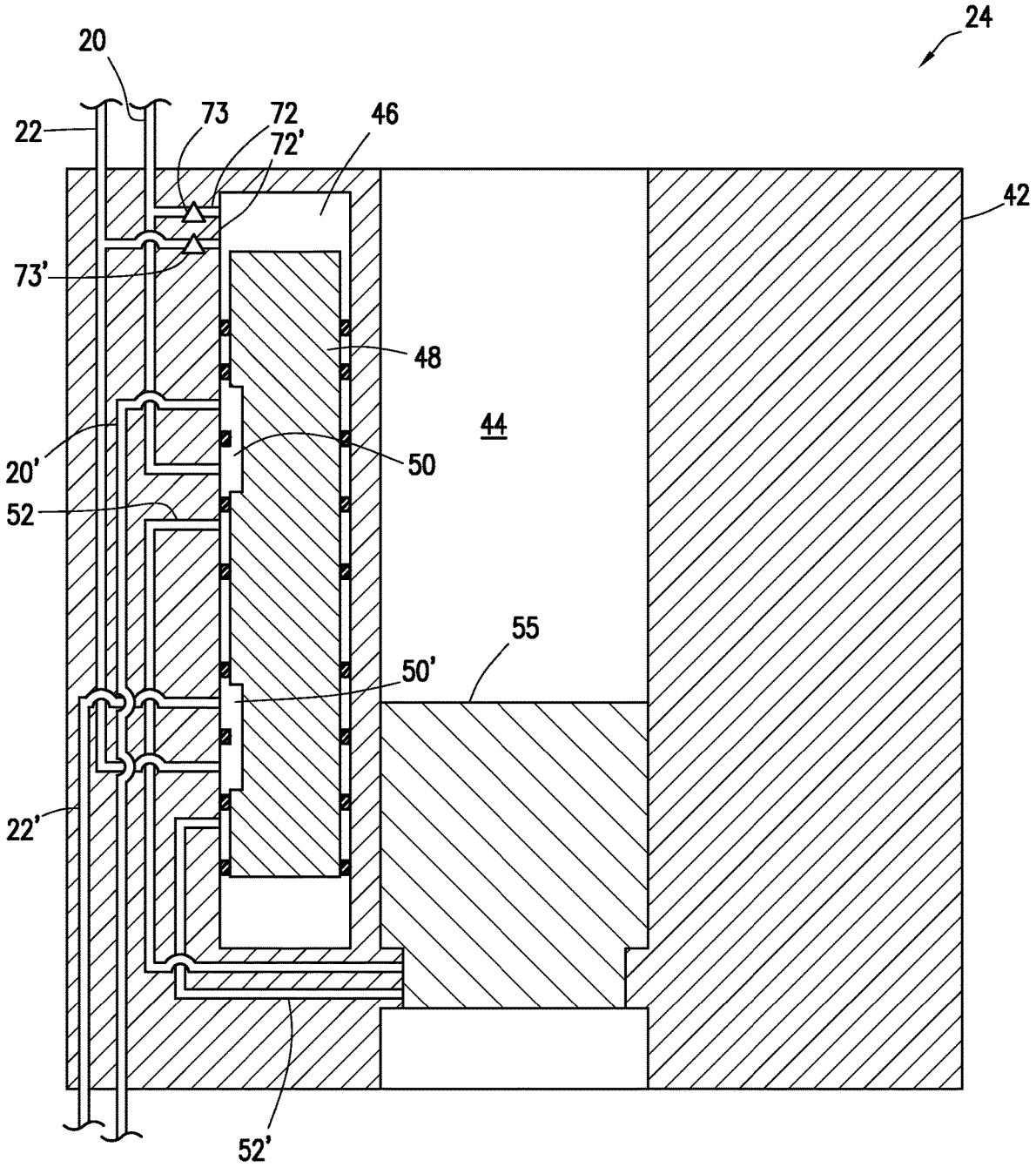
FIGS. 5A and 5B show an illustrative nipple configuration that may affect simultaneous switching of a control line and a balance line upon direct over-pressurization of either line.
Figure 5B:
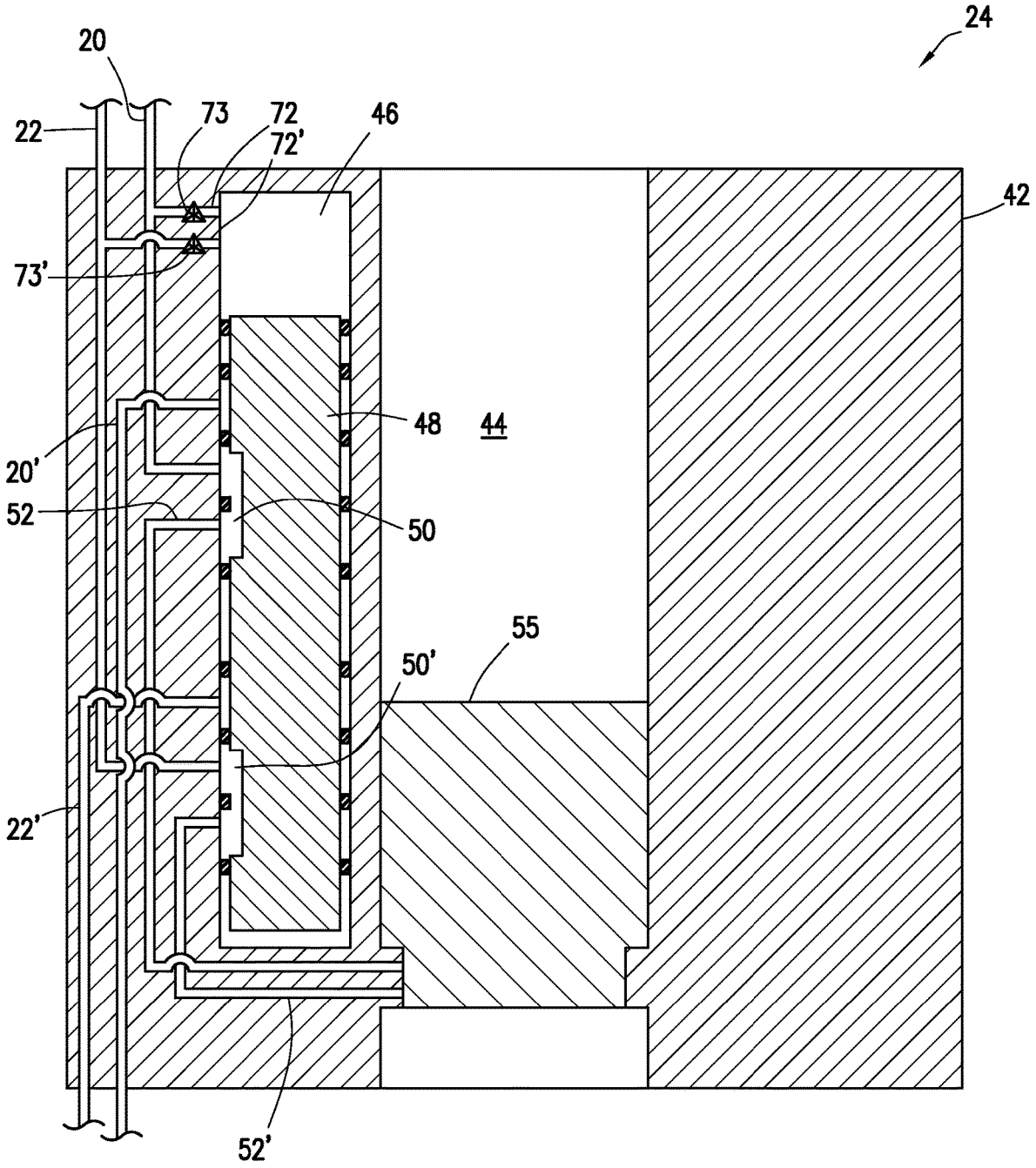

FIGS. 5A and 5B show an illustrative nipple configuration that may affect simultaneous switching of a control line and a balance line upon direct over-pressurization of either line. As shown, nipple 24 includes housing 42 and bore 44.

Within bore 44, insert safety valve 55 can be placed at a desired time. Switching chamber 46 is defined within housing 42, and hydraulic spool 48 is disposed therein. Hydraulic spool 48 contains recesses 50 and 50' through which hydraulic fluid from control line 20 or balance line 22 may pass to control line 20' or balance line 22', respectively, in the normal operational configuration of FIG. 5A.

Unlike FIGS. 3A-3D and 4A-4D, in which there are crossover hydraulic lines 25 and 27 between control line 20 and balance line 22, control line 20 and balance line 22 depicted in FIG. 5A are each configured for directly affecting movement of hydraulic spool 48 upon over-pressurization. Specifically, in FIGS. 5A and 5B, control line 20 includes branch line 72 and balance line 22 includes branch line 72', each extending to the headspace of switching chamber 46. Within branch lines 72 and 72', pressure-actuated devices 73 and 73' are present. Suitable pressure-actuated devices 73 and 73' have been described hereinabove. Upon over-pressurizing either control line 20 or balance line 22, corresponding pressure-actuated device 73 or 73' activates to release the excess hydraulic pressure and allow fluid access to branch line 72 or 72'. By opening branch line 72 or 72' through over-pressurization, switching chamber 46 may be pressurized in a manner similar to that described above in order to force hydraulic spool 48 downward. Upon downward movement of hydraulic spool 48, fluid access to control line 20' and balance line 22' is terminated, and latent hydraulic lines 52 and 52' become active for regulating insert safety valve 55. FIG. 5B shows the switched configuration in which hydraulic spool 48 has shifted downward and transferred hydraulic control to within nipple 24.

As discussed in more detail above in reference to FIGS. 4C and 4D, it is again to be recognized that hydraulic spool 48 may be tubular in nature and be disposed circumferentially within the sidewall of nipple 24. Switching chamber 46 may similarly be disposed circumferentially within the sidewall of nipple 24. Hence, the nipple configuration of FIGS. 5A and 5B should not be considered limiting.

In the configurations described above (see FIGS. 3A-3D, 4A-4D and 5A-5B), over-pressurization of control line 20 or balance line 22 may redirect hydraulic pressure from a primary safety valve to within nipple 24, in which insert safety valve 55 is to be deployed. The redirection may be direct (see FIGS. 5A and 5B) or result from crossover over-pressurization (see FIGS. 3A-3D and 4A-4D). In an alternative configuration, pressurization originating from within the wellbore itself may be used to affect switching of hydraulic control from a safety valve to nipple 24 in which insert safety valve 55 is deployed. Pressurization and switching may occur through the very action of deploying insert safety valve 55 within nipple 24. A particular advantage of utilizing wellbore pressurization to affect switching to insert safety valve 55 is that switching may still occur even if both control line 20 and balance line 22 have become inoperable.

Figure 6A:
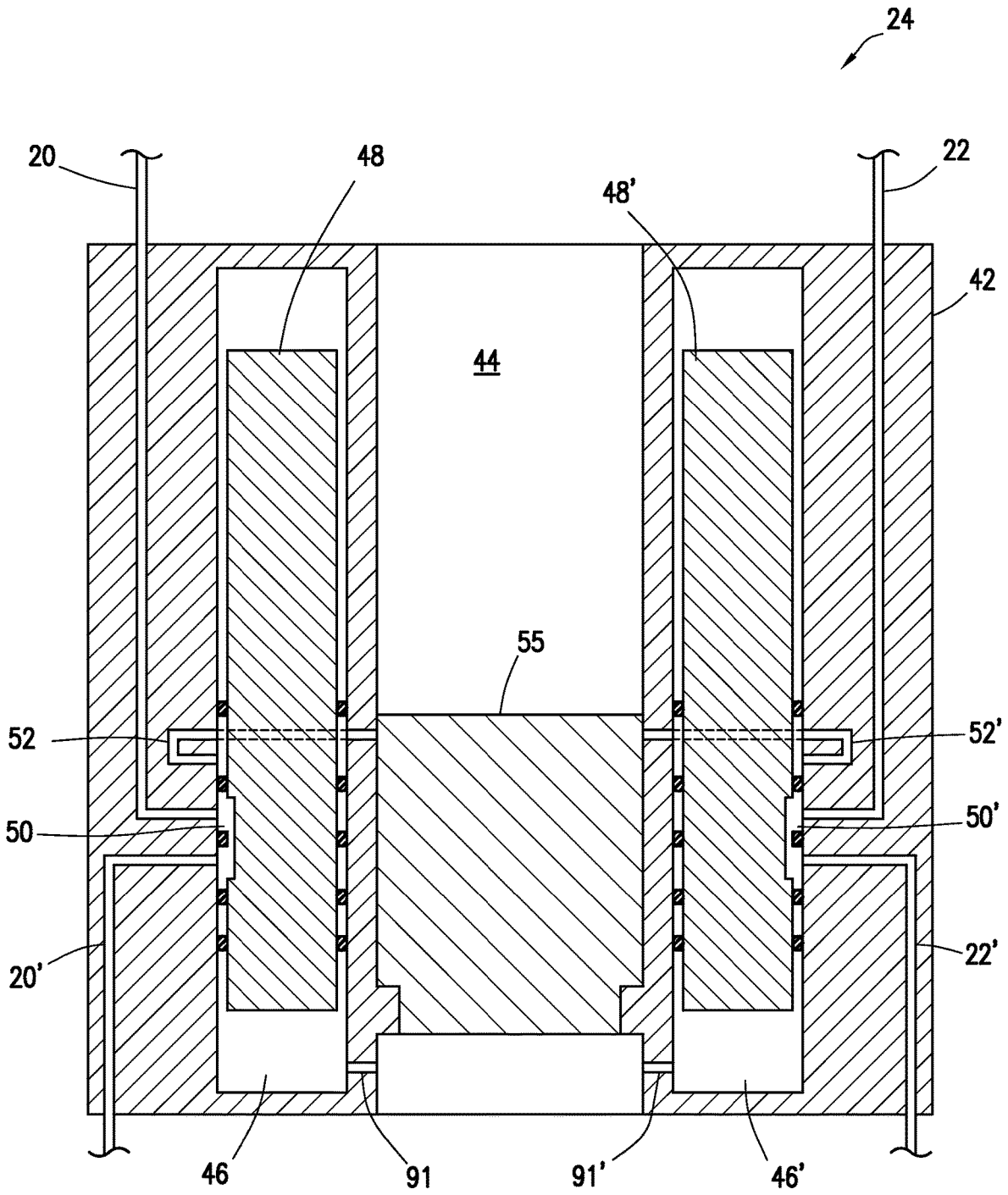
FIGS. 6A-6D, 7A and 7B show schematics of illustrative nipple configurations in which hydraulic switching to an insert safety valve can occur upon establishing a pressure differential between a lower bore section and an upper bore section.

FIGS. 6A-6D show schematics of illustrative nipple configurations in which hydraulic switching to an insert safety valve can occur upon establishing a pressure differential between a lower bore section and an upper bore section. As shown in FIG. 6A, nipple 24 includes housing 42 and bore 44 centrally defined therein. Within bore 44, insert safety valve 55 is positioned through a suitable technique, thereby defining an upper bore section and a lower bore section. Bore 44 may have a profile configured for positioning insert safety valve 55 therein, such as threads, landing shoulders or the like upon which insert safety valve 55 may rest and/or be retained. Insert safety valve 55 is placed in bore 44 such that its flapper valve (not depicted for clarity) is closed, or the flapper valve is closed after positioning insert safety valve 55 within bore 44. Since insert safety valve 55 is closed, wellbore fluids are no longer able to traverse the entirety of bore 44 and pressure builds in the lower bore section as a result.

As in other nipple configurations described herein, control line 20 and balance line 22 are configured to be transferrable from a primary safety valve (again, not shown in FIGS. 6A-6D) to nipple 24 such that insert safety valve 55 may be hydraulically controlled. Housing 42 includes pressurization chambers 46 and 46', in which hydraulic spools 48 and 48' are disposed. Switching conduits 91 and 91' are in fluid communication with a lower portion of pressurization chambers 46 and 46' and allow pressurization to take place upon establishing a pressure differential originating within the lower bore section upon placement of insert safety valve 55. Hydraulic spools 48 and 48' include recesses 50 and 50'. Control lines 20 and 20' initially maintain hydraulic communication with a safety valve via recess 50, and balance lines 22 and 22' initially maintain hydraulic communication with the safety valve via recess 50'. As discussed above, recesses 50 and 50' may be disposed upon a single hydraulic spool (see FIGS. 6C and 6D).

Figure 6B:
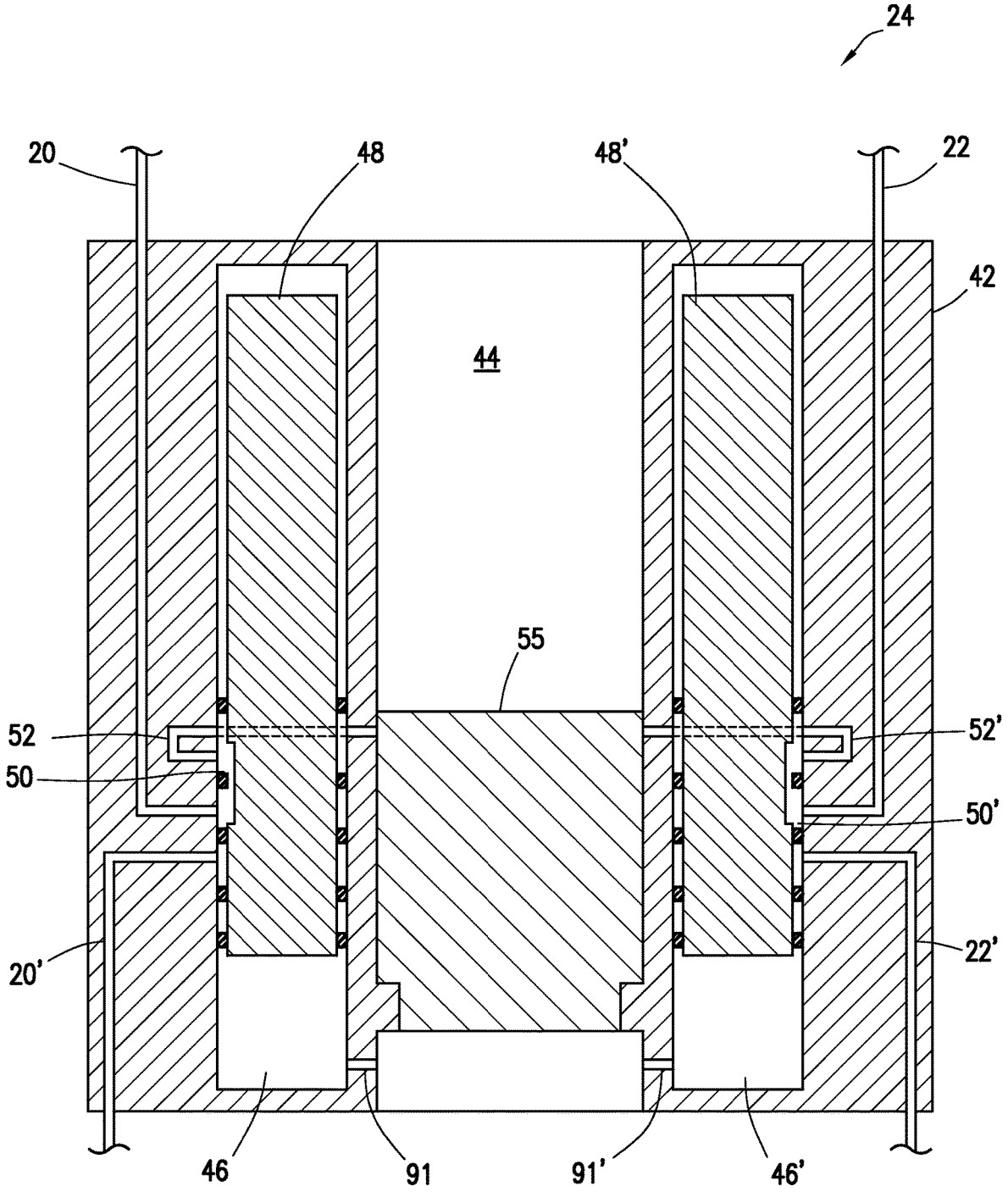

Upon pressurizing pressurization chambers 46 and 46' via the wellbore pressure differential originating within the lower bore section, hydraulic spools 48 and 48' rise in response to the increased hydraulic pressure, as shown in FIG. 6B. Hydraulic spools 48 and 48' may remain in this position, even when the wellbore pressure drops, through using a suitable technique to retain their engaged position. In illustrative embodiments, an up stop may be used for this purpose. Upon the upward movement of hydraulic spools 48 and 48', recesses 50 and 50' are no longer positioned to maintain fluid communication between control lines 20 and 20' and balance lines 22 and 22', thereby shutting off hydraulic communication to the primary safety valve below nipple 24. Instead, with the upward movement of hydraulic spools 48 and 48', recesses 50 and 50' establish fluid communication between control line 20 and latent hydraulic line 52 and between balance line 22 and latent hydraulic line 52'. Latent hydraulic lines 52 and 52' are defined within housing 42 and extend from pressurization chambers 46 and 46' to insert safety valve 55 to establish hydraulic communication therewith. Once hydraulic communication has been established with insert safety valve 55, it may be controlled with control line 20 and balance line 22 in a manner similar to that described above.

Figure 6C:
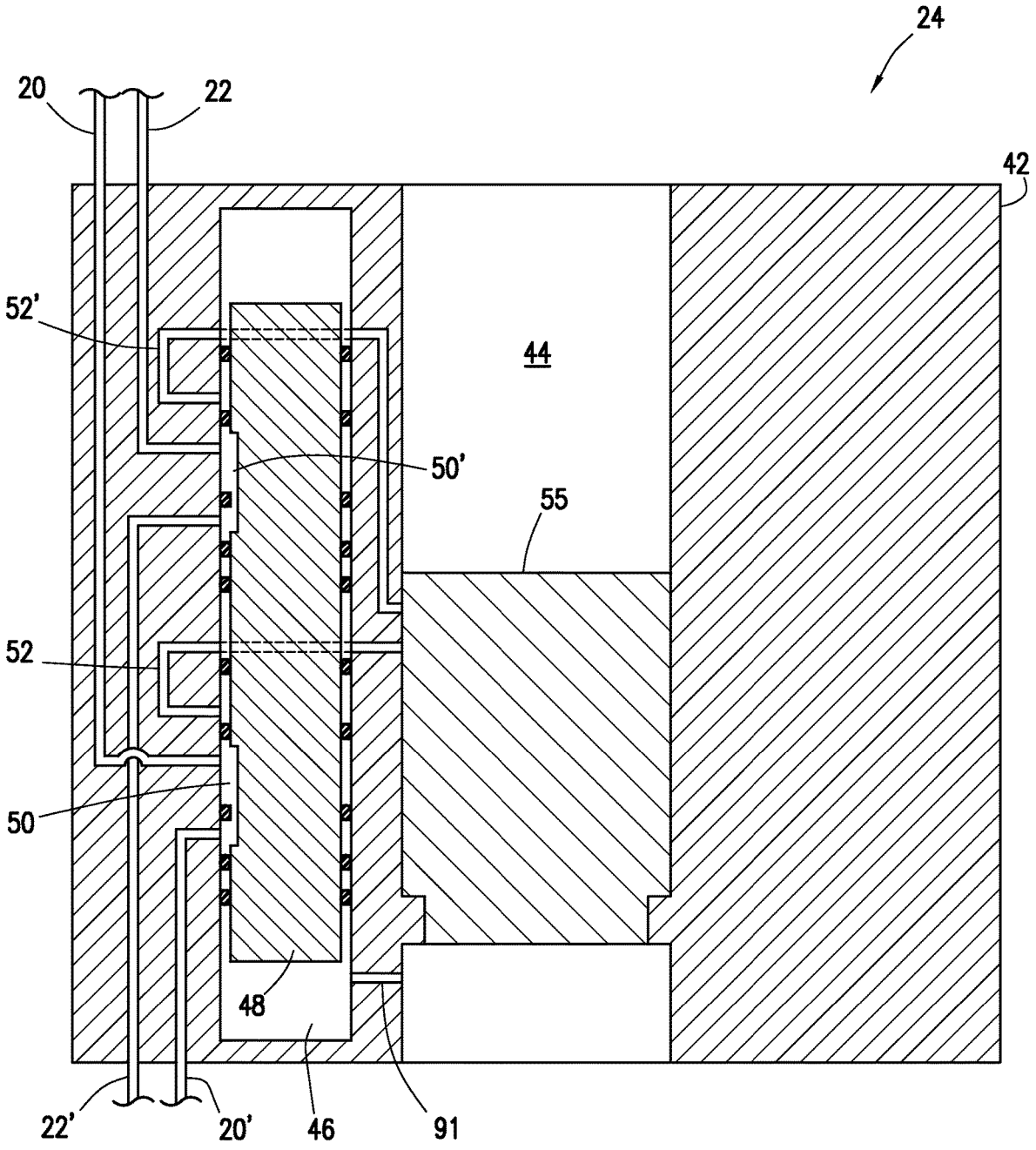
Figure 6D:
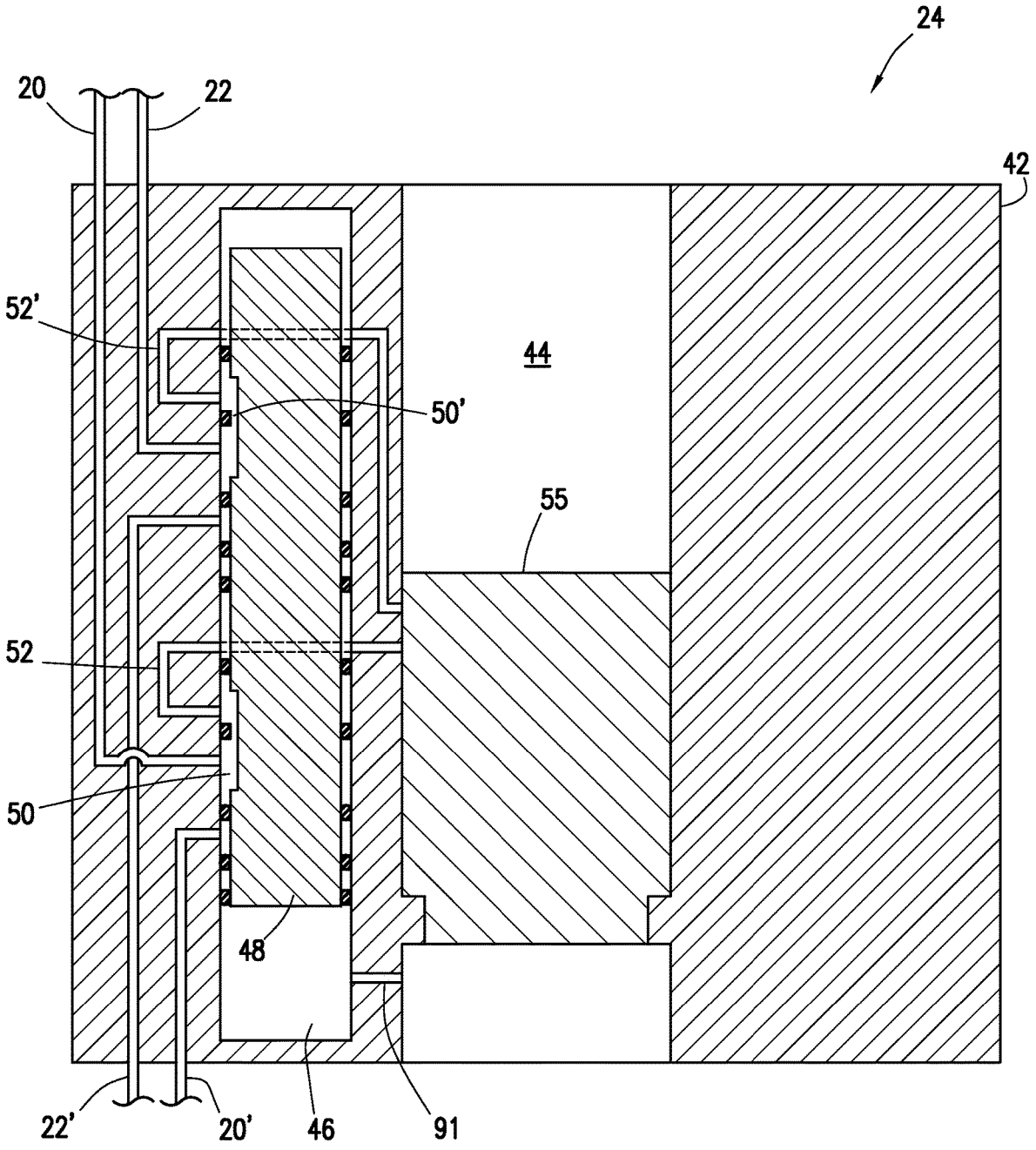
Figure 7A:
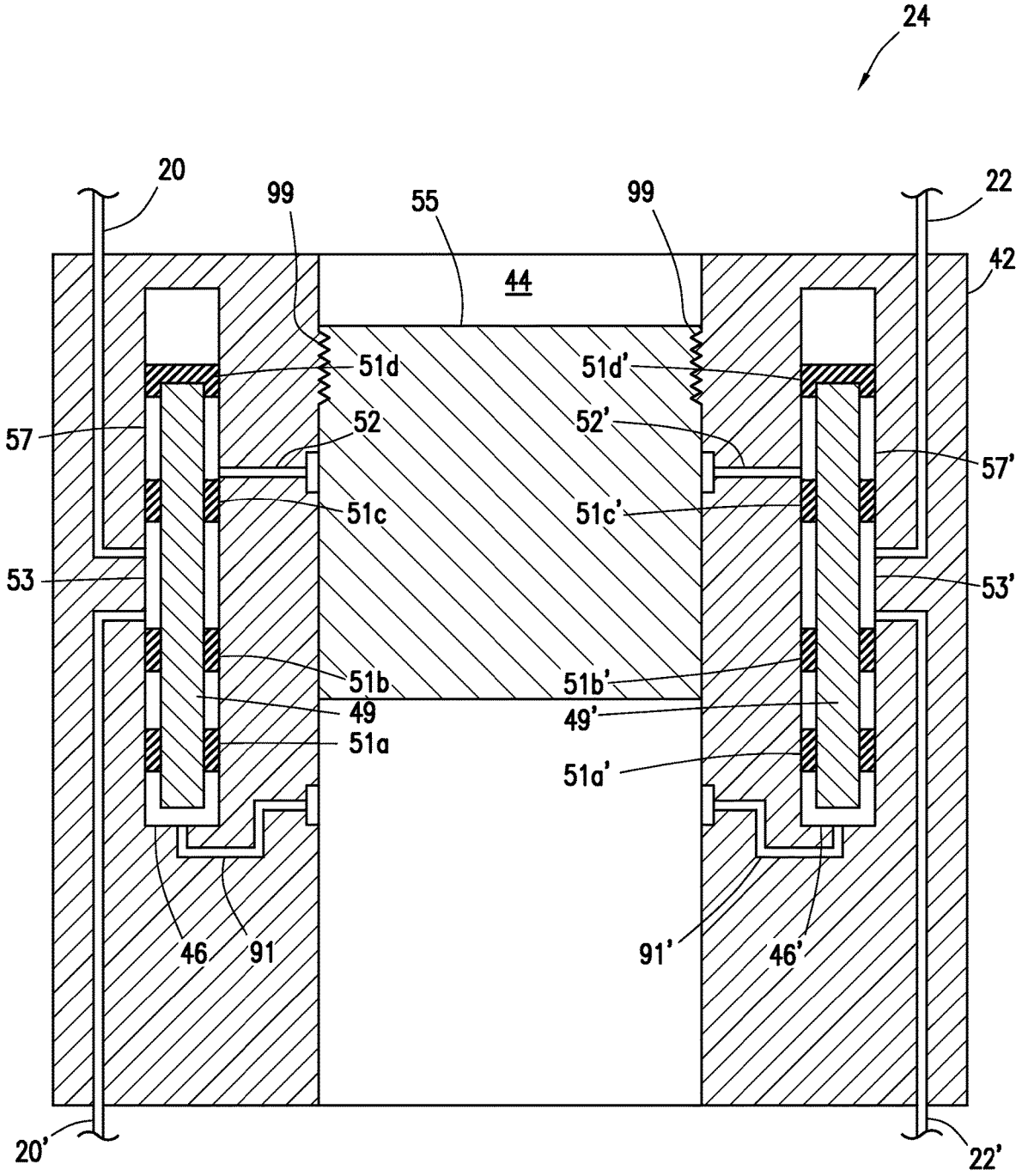
Figure 7B:
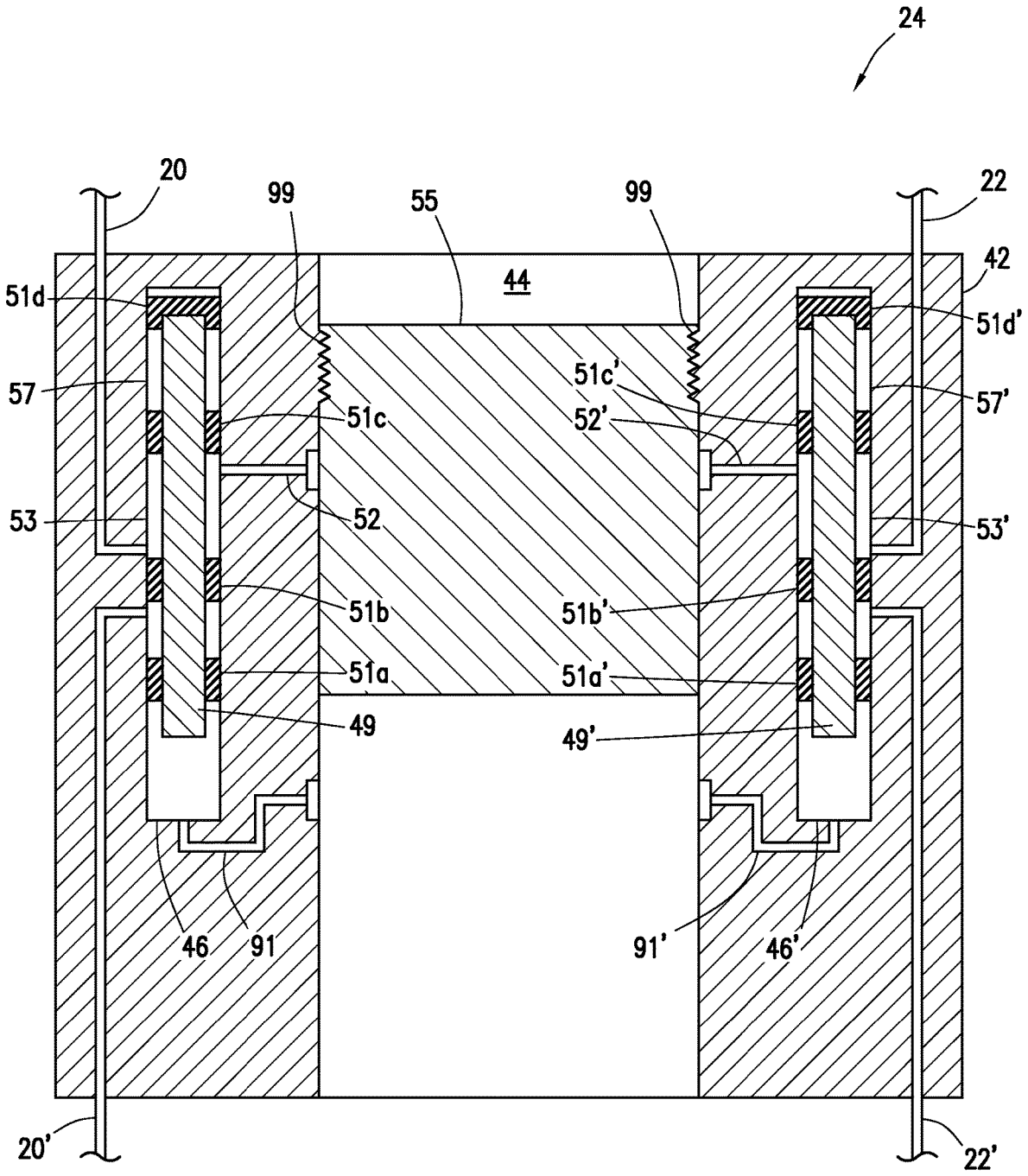

FIGS. 7A and 7B show schematics of illustrative alternative nipple configurations in which hydraulic switching to an insert safety valve can occur upon establishing a pressure differential between a lower bore section and an upper bore section. As in FIGS. 6A-6D, nipple 24 includes housing 42 and bore 44 defined centrally therein. Insert safety valve 55 is positioned within bore 55, thereby defining an upper bore section above insert safety valve 55 and a lower bore section below insert safety valve 55. Bore 44 includes profile features 99 that are configured to contact insert safety valve 55, such as threads, landing shoulders and the like to assist in properly positioning insert safety valve 55 within bore 44.

Pressurization chambers 46 and 46' reside within housing 42 and pistons 49 and 49' are disposed therein. Seals 51*a*-51*d* define a series of flow chambers within pressurization chamber 46, and seals 51*a*'-51*d*' define a corresponding series of flow chambers within pressurization chamber 46'. In the un-switched configuration of FIG. 7A, control line 20 is in hydraulic communication with a primary safety valve (not depicted) via flow chamber 53 and control line 20'. Likewise, balance line 22 is in hydraulic communication with the primary safety valve via flow chamber 53' and balance line 22'. As noted above, the hydraulic communication for either of these lines may have been interrupted, which may have prompted placing insert safety valve 55 in bore 44. Initially, latent hydraulic lines 52 and 52' are in fluid communication with flow chambers 57 and 57', respectively, and are unable to provide hydraulic control of insert safety valve 55 as a result.

Upon placing insert safety valve 55 in bore 44, a pressure rise occurs within the lower section of bore 44, and switching conduits 91 and 91' communicate the hydraulic pressure to pressurization chambers 46 and 46', respectively. Upon sufficiently pressurizing pressurization chambers 46 and 46', pistons 49 and 49' rise, and the associated flow chambers also move correspondingly (FIG. 7B). Upon shifting upwardly, control line 20' is no longer in fluid communication with flow chamber 53, and balance line 22' is no longer in fluid communication with flow chamber 53'. Instead, upon moving flow chamber 53 upwardly, control line 20 establishes fluid communication with latent hydraulic line 52 via flow chamber 53, and balance line 22 establishes fluid communication with latent hydraulic line 52' via flow chamber 53'. Accordingly, hydraulic control of the primary safety valve is shut off, and insert safety valve 55 may be hydraulically controlled by control line 20 and balance line 22.

Although FIGS. 7A and 7B have shown control line 20 and balance line 22 being switched with separate pistons 49 and 49', it is to be recognized that they may be switched with a single piston in a manner similar to that depicted in FIGS. 6C and 6D. Alternately, pistons may be daisy-chained together to provide a similar result. Moreover, although FIG. 7B have shown latent hydraulic lines 52 and 52' being disposed in substantially the same vertical position relative to bore 44, this need not necessarily be the case. That is, latent hydraulic lines 52 and 52' and their associated bore profile features may be vertically offset from one another.

Embodiments disclosed herein include:

A. Wellbore systems whose hydraulic regulation may be transferred from a primary safety valve to an insert safety valve. The wellbore systems comprise: a tubing string comprising a nipple and a primary safety valve, the primary safety valve being disposed in the tubing string below the nipple; and a control line and a balance line in hydraulic communication with the primary safety valve and in latent hydraulic communication with one or more switching mechanisms in the nipple; wherein the one or more switching mechanisms in the nipple are actuable to shut off the hydraulic communication of the control line and the balance line below the nipple and to redirect, via one or more latent hydraulic lines, the hydraulic communication of the control line and the balance line to an insert safety valve positioned in a bore of the nipple.

B. A method for transferring hydraulic regulation in a wellbore system by over-pressurizing one or more of a control line or a balance line. The methods comprise: placing a tubing string comprising a nipple and a primary safety valve into a wellbore, the primary safety valve being disposed in the tubing string below the nipple and the primary safety valve having a control line and a balance line in hydraulic communication therewith; wherein the control line and the balance line are also in latent hydraulic communication with one or more switching mechanisms in the nipple; and actuating the one or more switching mechanisms by over-pressurizing the control line, the balance line or both the control line and the balance line to shut off the hydraulic communication below the nipple and to redirect, via one or more latent hydraulic lines, the hydraulic communication of the control line and the balance line to an insert safety valve positioned in a bore of the nipple.

C. A method for transferring hydraulic regulation in a wellbore system by pressurizing a nipple bore. The methods comprise: placing a tubing string comprising a nipple and a primary safety valve into a wellbore, the primary safety valve being disposed in the tubing string below the nipple and the primary safety valve having a control line and a balance line in hydraulic communication therewith; wherein the control line and the balance line are also in latent hydraulic communication with one or more switching mechanisms in the nipple; and actuating the one or more switching mechanisms by pressurizing the bore of the nipple to shut off the hydraulic communication below the nipple and to redirect, via one or more latent hydraulic lines, the hydraulic communication of the control line and the balance line to an insert safety valve positioned in a bore of the nipple.

Each of embodiments A-C may have one or more of the following additional elements in any combination:

Element 1: wherein the one or more switching mechanisms actuate upon over-pressurization of the control line, the balance line, or both the control line and the balance line.

Element 2: wherein the wellbore system further comprises: first and second crossover hydraulic lines extending between the control line and the balance line, the first and second crossover hydraulic lines being in hydraulic communication with the one or more switching mechanisms in the nipple; a first pressure-actuated device interposed between the control line and the balance line in the first crossover hydraulic line; and a second pressure-actuated device interposed between the control line and the balance line in the second crossover hydraulic line.

Element 3: wherein the one or more switching mechanisms comprise one or more hydraulic spools that are actuable to establish hydraulic communication between an upper portion of the control line and a first latent hydraulic line and between an upper portion of the balance line and a second latent hydraulic line.

Element 4: wherein a first switching mechanism switches the control line and a second switching mechanism switches the balance line.

Element 5: wherein a single switching mechanism switches the control line and the balance line simultaneously.

Element 6: wherein the wellbore system further comprises: a first branch line extending from the control line, the first branch line being in latent hydraulic communication with the at least one switching mechanism and having a first pressure-actuated device interposed between the control line and the at least one switching mechanism; and a second branch line extending from the balance line, the second branch line being in latent hydraulic communication with the at least one switching mechanism and having a second pressure-actuated device interposed between the balance line and the at least one switching mechanism.

Element 7: wherein the at least one switching mechanism comprises at least one hydraulic spool.

Element 8: wherein a single switching mechanism switches the control line and the balance line simultaneously.

Element 9: wherein the one or more switching mechanisms actuate upon establishing a pressure differential between a lower section of a bore of the nipple and an upper section of the bore of the nipple.

Element 10: wherein the one or more switching mechanisms comprise one or more hydraulic spools or pistons, the wellbore system further comprising: one or more switching conduits that establish hydraulic communication between the one or more switching mechanisms and the bore of the nipple.

Element 11: wherein a first switching mechanism switches the control line and a second switching mechanism switches the balance line.

Element 12: wherein a single switching mechanism switches the control line and the balance line simultaneously.

Element 13: wherein over-pressurizing the control line or the balance line actuates a first switching mechanism within a one of the control line or the balance line that is not over-pressurized.

Element 14: wherein the method further comprises: after actuating the first switching mechanism, over-pressurizing a one of the control line or the balance line that was not originally over-pressurized to actuate a second switching mechanism for a one of the control line or the balance line that was originally over-pressurized.

Element 15: wherein a single switching mechanism switches the control line and the balance line simultaneously upon over-pressurization of either line.

Element 16: wherein the one or more switching mechanisms comprise one or more hydraulic spools that, upon actuation, establish hydraulic communication between an upper portion of the control line and a first latent hydraulic line and between an upper portion of the balance line and a second latent hydraulic line.

Element 17: wherein the one or more switching mechanisms comprise one or more hydraulic spools or pistons, and one or more switching conduits establish hydraulic communication between the one or more switching mechanisms and the bore of the nipple.

By way of non-limiting example, exemplary combinations applicable to A-C include:

The wellbore system of A in combination with elements 1 and 4.

The wellbore system of A in combination with elements 1 and 5.

The wellbore system of A in combination with elements 1-4.

The wellbore system of A in combination with elements 1-3 and 5.

The wellbore system of A in combination with elements 6 and 7.

The wellbore system of A in combination with elements 6-8.

The wellbore system of A in combination with elements 9 and 10.

The wellbore system of A in combination with elements 9-11.

The wellbore system of A in combination with elements 9, 10 and 12.

The method of B in combination with elements 13 and 14.

The method of B in combination with elements 13, 14 and 17.

The method of B in combination with elements 13, 15 and 17.

The method of B in combination with elements 13 and 16.

The method of B in combination with elements 15 and 16.

The method of C in combination with elements 4 and 17.

The method of C in combination with elements 5 and 17.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A wellbore system comprising:

a tubing string comprising a nipple and a primary safety valve, the primary safety valve being disposed in the tubing string below the nipple;

a control line and a balance line in hydraulic communication with the primary safety valve and in latent hydraulic communication with one or more switching mechanisms in the nipple;

first and second crossover hydraulic lines extending between the control line and the balance line, the first and second crossover hydraulic lines being in hydraulic communication with the one or more switching mechanisms in the nipple;

a first pressure-actuated device interposed between the control line and the balance line in the first crossover hydraulic line; and a second pressure-actuated device interposed between the control line and the balance line in the second crossover hydraulic line;

wherein the one or more switching mechanisms in the nipple are actuable to shut off the hydraulic communication of the control line and the balance line below the nipple and to redirect, via one or more latent hydraulic lines, the hydraulic communication of the control line and the balance line to an insert safety valve positioned in a bore of the nipple.

2. The wellbore system of claim 1, wherein the one or more switching mechanisms actuate upon over-pressurization of the control line, the balance line, or both the control line and the balance line.

3. The wellbore system of claim 1, wherein the one or more switching mechanisms comprise one or more hydraulic spools that are actuable to establish hydraulic communication between a portion of the control line and a first latent hydraulic line and between a portion of the balance line and a second latent hydraulic line.

4. The wellbore system of claim 3, wherein a first switching mechanism switches the control line and a second switching mechanism switches the balance line.

5. The wellbore system of claim 3, wherein a single switching mechanism switches the control line and the balance line simultaneously.

6. The wellbore system of claim 1, further comprising:

a first branch line extending from the control line, the first branch line being in latent hydraulic communication with the at least one switching mechanism and having a first pressure-actuated device interposed between the control line and the at least one switching mechanism; and a second branch line extending from the balance line, the second branch line being in latent hydraulic communication with the at least one switching mechanism and having a second pressure-actuated device interposed between the balance line and the at least one switching mechanism.

7. The wellbore system of claim 6, wherein the at least one switching mechanism comprises at least one hydraulic spool.

8. The wellbore system of claim 1, wherein the one or more switching mechanisms actuate upon establishing a pressure differential between a section of a bore of the nipple and another section of the bore of the nipple.

9. The wellbore system of claim 8, wherein the one or more switching mechanisms comprise one or more hydraulic spools or pistons, the wellbore system further comprising:

one or more switching conduits that establish hydraulic communication between the one or more switching mechanisms and the bore of the nipple.

10. The wellbore system of claim 9, wherein a single switching mechanism switches the control line and the balance line simultaneously.

11. A method comprising:

placing a tubing string comprising a nipple and a primary safety valve into a wellbore, the primary safety valve being disposed in the tubing string below the nipple and the primary safety valve having a control line and a balance line in hydraulic communication therewith;

wherein the control line and the balance line are also in latent hydraulic communication with one or more switching mechanisms in the nipple;

actuating the one or more switching mechanisms by over-pressurizing the control line, the balance line or both the control line and the balance line to shut off the hydraulic communication below the nipple and to redirect, via one or more latent hydraulic lines, the hydraulic communication of the control line and the balance line to an insert safety valve positioned in a bore of the nipple; and after actuating the first switching mechanism, over-pressurizing a one of the control line or the balance line that was not originally over-pressurized to actuate a second switching mechanism for a one of the control line or the balance line that was originally over-pressurized.

12. The method of claim 11, wherein over-pressurizing the control line or the balance line actuates a first switching mechanism within a one of the control line or the balance line that is not over-pressurized.

13. The method of claim 11, wherein a single switching mechanism switches the control line and the balance line simultaneously upon over-pressurization of either line.

14. The method of claim 11, wherein the one or more switching mechanisms comprise one or more hydraulic spools that, upon actuation, establish hydraulic communication between a portion of the control line and a first latent hydraulic line and between a portion of the balance line and a second latent hydraulic line.

15. A method comprising:

placing a tubing string comprising a nipple and a primary safety valve into a wellbore, the primary safety valve being disposed in the tubing string below the nipple and the primary safety valve having a control line and a balance line in hydraulic communication therewith;

wherein the control line and the balance line are also in latent hydraulic communication with one or more switching mechanisms in the nipple;

actuating the one or more switching mechanisms by pressurizing a bore of the nipple to shut off the hydraulic communication below the nipple and to redirect, via one or more latent hydraulic lines, the hydraulic communication of the control line and the balance line to an insert safety valve positioned in a bore of the nipple; and after actuating the first switching mechanism, over-pressurizing a one of the control line or the balance line that was not originally over-pressurized to actuate a second switching mechanism for a one of the control line or the balance line that was originally over-pressurized.

16. The method of claim 15, wherein the one or more switching mechanisms comprise one or more hydraulic spools or pistons, and one or more switching conduits establish hydraulic communication between the one or more switching mechanisms and the bore of the nipple.

17. The method of claim 16, wherein a first switching mechanism switches the control line and a second switching mechanism switches the balance line.

18. The method of claim 16, wherein a single switching mechanism switches the control line and the balance line simultaneously.

* * * * *